United States Patent [19]

Yuzawa

[11] Patent Number: 4,539,882

[45] Date of Patent: Sep. 10, 1985

[54] AUTOMATIC ACCOMPANIMENT GENERATING APPARATUS

[75] Inventor: Keiji Yuzawa, Akishima, Japan

[73] Assignee: Casio Computer Co., Ltd., Tokyo, Japan

[21] Appl. No.: 451,816

[22] Filed: Dec. 21, 1982

[30] Foreign Application Priority Data

Dec. 28, 1981 [JP] Japan ..... 56-210989
Jul. 15, 1982 [JP] Japan ..... 57-122158

[51] Int. Cl.[3] ..... G10F 1/00
[52] U.S. Cl. ..... 84/1.03; 84/DIG. 22
[58] Field of Search ..... 84/1.03, 1.01, DIG. 22, 84/1.24

[56] References Cited

U.S. PATENT DOCUMENTS 4,012,979 3/1977 Wemekamp ..... 84/1.01
4,292,874 10/1981 Jones et al. ..... 84/1.03
4,339,978 7/1982 Imamura ..... 84/1.03
4,361,067 11/1982 Ishii ..... 84/1.03
4,387,618 6/1983 Simmons, Jr. ..... 84/1.03
4,417,494 11/1983 Nakada et al. ..... 84/1.03
4,450,742 5/1984 Sugiura ..... 84/1.03
4,454,796 6/1984 Inove et al. ..... 84/1.03

FOREIGN PATENT DOCUMENTS 2808285 9/1980 Fed. Rep. of Germany .
3151607 7/1982 Fed. Rep. of Germany .

*Primary Examiner*—Forester W. Isen
*Attorney, Agent, or Firm*—Frishauf, Holtz, Goodman & Woodward

[57] ABSTRACT

A plurality of tone data indicative of the pitch and duration of a series of tones forming the melody of a number are stored in a performance memory by operating a key input section. Accompaniment chord data can be automatically obtained from an automatic chord generating circuit according to the tone data stored in the performance memory in which the accompaniment chord data thus obtained are stored together with melody data.

33 Claims, 47 Drawing Figures

FIG. 8

| NOTE | CODE | | | | | NOTE | CODE | | | | |
|---|---|---|---|---|---|---|---|---|---|---|---|
| F4 | 0 | 0 | 0 | 0 | 1 | A5 | 1 | 0 | 0 | 0 | 1 |
| F4# | 0 | 0 | 0 | 1 | 0 | A5# | 1 | 0 | 0 | 1 | 0 |
| G4 | 0 | 0 | 0 | 1 | 1 | B5 | 1 | 0 | 0 | 1 | 1 |
| G4# | 0 | 0 | 1 | 0 | 0 | C6 | 1 | 0 | 1 | 0 | 0 |
| A4 | 0 | 0 | 1 | 0 | 1 | C6# | 1 | 0 | 1 | 0 | 1 |
| A4# | 0 | 0 | 1 | 1 | 0 | D6 | 1 | 0 | 1 | 1 | 0 |
| B4 | 0 | 0 | 1 | 1 | 1 | D6# | 1 | 0 | 1 | 1 | 1 |
| C5 | 0 | 1 | 0 | 0 | 0 | E6 | 1 | 1 | 0 | 0 | 0 |
| C5# | 0 | 1 | 0 | 0 | 1 | F6 | 1 | 1 | 0 | 0 | 1 |
| D5 | 0 | 1 | 0 | 1 | 0 | F6# | 1 | 1 | 0 | 1 | 0 |
| D5# | 0 | 1 | 0 | 1 | 1 | G6 | 1 | 1 | 0 | 1 | 1 |
| E5 | 0 | 1 | 1 | 0 | 0 | G6# | 1 | 1 | 1 | 0 | 0 |
| F5 | 0 | 1 | 1 | 0 | 1 | A6 | 1 | 1 | 1 | 0 | 1 |
| F5# | 0 | 1 | 1 | 1 | 0 | A6# | 1 | 1 | 1 | 1 | 0 |
| G5 | 0 | 1 | 1 | 1 | 1 | B6 | 1 | 1 | 1 | 1 | 1 |
| G5# | 1 | 0 | 0 | 0 | 0 | DUMMY | 0 | 0 | 0 | 0 | 0 |

FIG. 9

| FLAG | CODE |
|---|---|
| NOTE | 0 |
| CHORD | 1 |

FIG. 10

| S/R | CODE | |
|---|---|---|
| 1/3 | 0 | 1 |
| 2/2 | 1 | 0 |
| 3/1 | 1 | 1 |

FIG. 11

| S/R | CODE | | |
|---|---|---|---|
| 1/7 | 0 | 0 | 1 |
| 2/6 | 0 | 1 | 0 |
| 3/5 | 0 | 1 | 1 |
| 4/4 | 1 | 0 | 0 |
| 5/3 | 1 | 0 | 1 |
| 6/2 | 1 | 1 | 0 |
| 7/1 | 1 | 1 | 1 |

FIG. 12

| ROOT | CODE | | | |
|---|---|---|---|---|
| C | 0 | 0 | 0 | 1 |
| C# | 0 | 0 | 1 | 0 |
| D | 0 | 0 | 1 | 1 |
| D# | 0 | 1 | 0 | 0 |
| E | 0 | 1 | 0 | 1 |
| F | 0 | 1 | 1 | 0 |
| F# | 0 | 1 | 1 | 1 |
| G | 1 | 0 | 0 | 0 |
| G# | 1 | 0 | 0 | 1 |
| A | 1 | 0 | 1 | 0 |
| A# | 1 | 0 | 1 | 1 |
| B | 1 | 1 | 0 | 0 |

FIG. 13

| SORT | CODE | | | |
|---|---|---|---|---|
| MAJOR | 0 | 0 | 0 | 1 |
| MINOR | 0 | 0 | 1 | 0 |
| 7 | 0 | 0 | 1 | 1 |
| MAJ7 | 0 | 1 | 0 | 0 |
| m7 | 0 | 1 | 0 | 1 |
| SUS4 | 0 | 1 | 1 | 0 |
| dim | 0 | 1 | 1 | 1 |
| 6 | 1 | 0 | 0 | 0 |
| MIN6 | 1 | 0 | 0 | 1 |

FIG. 14

| | MAXIMUM STORING DURATION | NUMBER OF BARS | NUMBER OF COUNTS |
|---|---|---|---|
| MELODY | 6.4 sec | 2 | 256 Φ |
| CHORD | 51.2 sec | 16 | 2048 Φ |
| TEMPO CLOCK Φ: 25ms ( STANDARD STATE ) ♩ = 74 | | | |

FIG. 15

| NOTE | ∅ | TIME (sec) | CODE | | | | | | | |
|---|---|---|---|---|---|---|---|---|---|---|
| 𝅘𝅥𝅯 | 8 | 0.2 | 0 | 0 | 0 | 0 | 1 | 0 | 0 | 0 |
| 𝅘𝅥𝅯 | 12 | 0.3 | 0 | 0 | 0 | 0 | 1 | 1 | 0 | 0 |
| 𝅘𝅥𝅰 | 16 | 0.4 | 0 | 0 | 0 | 1 | 0 | 0 | 0 | 0 |
| 𝅘𝅥𝅰. | 24 | 0.6 | 0 | 0 | 0 | 1 | 1 | 0 | 0 | 0 |
| 𝅘𝅥 | 32 | 0.8 | 0 | 0 | 1 | 0 | 0 | 0 | 0 | 0 |
| 𝅘𝅥. | 48 | 1.2 | 0 | 0 | 1 | 1 | 0 | 0 | 0 | 0 |
| 𝅗𝅥 | 64 | 1.6 | 0 | 1 | 0 | 0 | 0 | 0 | 0 | 0 |
| 𝅗𝅥. | 96 | 2.4 | 0 | 1 | 1 | 0 | 0 | 0 | 0 | 0 |
| 𝅝 | 128 | 3.2 | 1 | 0 | 0 | 0 | 0 | 0 | 0 | 0 |
| 𝅝 𝅗𝅥 | 192 | 4.8 | 1 | 1 | 0 | 0 | 0 | 0 | 0 | 0 |
| 𝅝 𝅝 | 256 | 6.4 | 1 | 1 | 1 | 1 | 1 | 1 | 1 | 1 |

FIG. 16

| | | | | | | | | | | | | | | | |
|---|---|---|---|---|---|---|---|---|---|---|---|---|---|---|---|
| DUMMY | La | La | La | Fa# | La | Si | La | Fa# | Fa# | Mi | Fa# | Mi | La | La | La |
| Fa# | La | Si | La | Fa# | Mi | Fa# | Mi | Re | La | La | La | Fa# | La | La | Si |
| La | Fa# | Fa# | Mi | Fa# | Mi | La | La | La | Fa# | La | La | Si | Si | La | La |
| Fa# | Mi | Fa# | Mi | Re | Re | Re | Fa# | La | Re | Si | Si | Re | Si | La | Fa# |
| Sol | La | La | Fa# | Fa# | La | La | Si | La | Fa# | Mi | Fa# | Sol | Fa# | Mi | Mi |
| Re | | | | | | | | | | | | | | | |

324 DIGIT

FIG. 20

| | KEY ACCORDING TO THE LAST NOTE POSITION | | | | | |
|---|---|---|---|---|---|---|
| LAST NOTE | MAJOR KEY NOTE | MINOR 3 DEGREES | MAJOR 5 DEGREES | MINOR KEY NOTE | MAJOR 3 DEGREES | MINOR 5 DEGREES |
| Do | C | Am | F | Cm | G# | Fm |
| Do# | C# | Am# | F# | C# | A | Fm# |
| Re | D | Bm | G | Dm | A# | Gm |
| Re# | D# | Cm | G# | Dm# | B | Gm# |
| Mi | E | Cm# | A | Em | C | Am |
| Fa | F | Dm | A# | Fm | C# | Am# |
| Fa# | F# | Dm# | B | Fm# | D | Bm |
| Sol | G | Em | C | Gm | D# | Cm |
| Sol# | G# | Fm | C# | Gm# | E | Cm# |
| La | A | Fm# | D | Am | F | Dm |
| La# | A# | Gm | D# | Am# | F# | Dm# |
| Si | B | Gm# | E | Bm | G | Em |

FIG. 21

| KEY | SCALE | | | | | | | | | | | |
|---|---|---|---|---|---|---|---|---|---|---|---|---|
| | Do | Do# | Re | Re# | Mi | Fa | Fa# | Sol | Sol# | La | La# | Si |
| C | ○ | | ○ | | ○ | ○ | | ○ | | ○ | | ○ |
| Cm | ○ | | ○ | ○ | | ○ | | ○ | ○ | | ○ | |
| F | ○ | | ○ | | ○ | ○ | | ○ | | ○ | ○ | |
| Fm | ○ | ○ | | ○ | →○ | ○ | | ○ | ○ | | ○ | |
| G# | ○ | ○ | | ○ | | ○ | | ○ | ○ | | ○ | |
| Am | ○ | | ○ | | ○ | ○ | | ○ | →○ | ○ | | ○ |

FIG. 22

| NOTE | TOTAL NOTE DURATION |
|---|---|
| Do | ♪x14 |
| Do# | 0 |
| Re | ♪x18+♪x1 |
| Re# | 0 |
| Mi | ♪x23+♪x1 |
| Fa | ♬x1 |
| Fa# | 0 |
| Sol | ♪x28 |
| Sol# | 0 |
| La | ♪x7 |
| La# | 0 |
| Si | 0 |

FIG. 25

| KEY | SCALE | | | | | | | | | | | |
|---|---|---|---|---|---|---|---|---|---|---|---|---|
| C · Am | Do | Do# | Re | Re# | Mi | Fa | Fa# | Sol | Sol# | La | La# | Si |
| C# · Am# | Si | Do | Do# | Re | Re# | Mi | Fa | Fa# | Sol | Sol# | La | La# |
| D · Bm | La# | Si | Do | Do# | Re | Re# | Mi | Fa | Fa# | Sol | Sol# | La |
| D# · Cm | La | La# | Si | Do | Do# | Re | Re# | Mi | Fa | Fa# | Sol | Sol# |
| E · Cm# | Sol# | La | La# | Si | Do | Do# | Re | Re# | Mi | Fa | Fa# | Sol |
| F · Dm | Sol | Sol# | La | La# | Si | Do | Do# | Re | Re# | Mi | Fa | Fa# |
| F# · Dm# | Fa# | Sol | Sol# | La | La# | Si | Do | Do# | Re | Re# | Mi | Fa |
| G · Em | Fa | Fa# | Sol | Sol# | La | La# | Si | Do | Do# | Re | Re# | Mi |
| G# · Fm | Mi | Fa | Fa# | Sol | Sol# | La | La# | Si | Do | Do# | Re | Re# |
| A · Fm# | Re# | Mi | Fa | Fa# | Sol | Sol# | La | La# | Si | Do | Do# | Re |
| A# · Gm | Re | Re# | Mi | Fa | Fa# | Sol | Sol# | La | La# | Si | Do | Do# |
| B · Gm# | Do# | Re | Re# | Mi | Fa | Fa | Sol | Sol# | La | La# | Si | Do |

FIG. 26

TABLE FOR ONE NOTE

| | MAJOR (C) | | | | | | | MINOR (Am) | | | | | | | |
|---|---|---|---|---|---|---|---|---|---|---|---|---|---|---|---|
| LC \ NI | Do | Re | Mi | Fa | Sol | La | Si | Do | Re | Mi | Fa | Sol | La | Si | LC |
| C | C | G7 | C | Dm | Em | Am | G7 | Am | Dm | E7 | Dm | Em | Am | E7 | C |
| Dm | C | G7 | C | Dm | G7 | Dm | G7 | F | Dm | Am | Dm | G7 | Am | E7 | Dm |
| Em | F | G7 | Am | F | C | F | Em | F | G7 | Am | F | C | Am | E7 | Em |
| F | C | G7 | Em | F | G7 | F | G7 | C | G7 | E7 | F | G7 | Am | E7 | F |
| G7 | C | G7 | C | F | C | F | G7 | F | G7 | C | F | C | Am | G7 | G7 |
| Am | F | Dm | C | F | G7 | Am | Em | Am | Dm | Am | Dm | G7 | Am | E7 | Am |
| E7 | Am | E7 | Am | Dm | C | Am | E7 | Am | E7 | Am | Dm | C | Am | E7 | E7 |
| OTH | C | G7 | C | F | C | F | G7 | Am | Dm | Am | Dm | C | Am | E | OTH |

FIG. 27

TABLE FOR TWO NOTES

| | MAJOR (C) | | | | | | | MINOR (Am) | | | | | | | |
|---|---|---|---|---|---|---|---|---|---|---|---|---|---|---|---|
| N2 \ N1 | Do | Re | Mi | Fa | Sol | La | Si | Do | Re | Mi | Fa | Sol | La | Si | N1 \ N2 |
| Do | C | Dm | C | F | C | F | GT1 | Am | Dm | Am | F | C | Am | GT1 | Do |
| Re | GT1 | G7 | GT1 | Dm | G7 | Dm | G7 | GT1 | Dm | GT1 | Dm | G7 | Dm | G7 | Re |
| Mi | C | GT1 | C | GT1 | C | Am | Em | Am | GT1 | Am | GT1 | Em | Am | Em | Mi |
| Fa | F | Dm | GT1 | F | G7 | F | G7 | F | Dm | GT1 | Dm | G7 | F | G7 | Fa |
| Sol | C | G7 | C | GT1 | C | GT1 | G7 | C | G7 | C | GT1 | C | GT1 | Em | Sol |
| La | Am | Dm | Am | Dm | GT1 | F | GT1 | Am | Dm | Am | Dm | GT1 | Am | GT1 | La |
| Si | GT1 | G7 | Em | G7 | G7 | Am | G7 | GT1 | G7 | Em | G7 | Em | Am | E7 | Si |
| Re#/Fa# | B7 | B7 | GT1 | B7 | B7 | B7 | B7 | B7 | B7 | GT1 | B7 | B7 | B7 | B7 | Re#/Fa# |
| Sol# | E7 | E7 | E7 | E7 | E7 | Am | E7 | E7 | E7 | E7 | E7 | E7 | Am | E7 | Sol# |

FIG. 28A

TABLE FOR THREE NOTES

| N1 | DO | | | | Re | | | | Mi | | | |
|---|---|---|---|---|---|---|---|---|---|---|---|---|
| | N3 | LC | | PC | N3 | LC | | PC | N3 | LC | | PC |
| | Mi | Sol | any | C | Fa | La | any | Dm | Sol | Si | any | Em |
| | Mi | La | any | Am | Sol | Si | any | G7 | Sol | Do | any | C |
| | Fa | La | any | F | Fa | Si | M | G7 | La | Do | any | Am |
| | Re | Mi | M | C | Fa | Si | Dm | E7 | Si | Re | any | E7 |
| | Re | Mi | any | Am | Fa | Si | any | Dm | Sol | Re | any | Em |
| | Sol | La | M | C | La | Do | any | Dm | Do | Re | Em | C |
| | Sol | La | any | Am | Fa | Do | any | Dm | Do | Re | G | C |
| | La | Si | G | Am | Mi | Fa | M | G7 | Do | Re | C | C |
| | La | Si | Em | Am | Mi | Fa | any | Dm | Do | Re | any | Am |
| | La | Si | any | F | Si | Do | Am | E7 | Sol | La | M | C |
| | Re | La | any | F | Si | Do | Dm | E7 | Sol | La | any | Am |
| | Re | Fa | any | Dm | Si | Do | E7 | E7 | La | Si | any | Am |
| | Re | Sol | any | C | Si | Do | any | G7 | Si | Do | any | E7 |
| | Fa | Sol | any | F | Mi | Do | N·L | Dm | La | Re | any | Am |
| | Sol | Si | any | C | Mi | Do | any | Am | Fa | La | any | Am |
| | Mi | Si | any | C | Mi | Sol | any | G7 | Fa | Do | any | Am |
| | Re | Si | M | Dm | La | La | any | Dm | Fa | Sol | M | C |
| | Re | Si | N·L | Am | Mi | Si | any | G7 | Fa | Sol | any | Em |
| | Re | Si | any | B7 | Sol | Sol | any | G7 | Fa | Re | M | Dm |
| | Fa | Fa | any | F | | | | | Fa | Re | any | E7 |
| | | | | | | | | | Fa | Si | any | E7 |

FIG. 28B

| Fa | | | | Sol | | | | La | | | | Si | | | |
|---|---|---|---|---|---|---|---|---|---|---|---|---|---|---|---|
| N3 | | LC | PC | N3 | | LC | PC | N3 | | LC | PC | N3 | | LC | PC |
| La | Do | any | F | Si | Re | any | G7 | Do | Mi | any | Am | Re | Sol | any | G7 |
| La | Re | any | Dm | Si | Mi | any | Em | Do | Fa | any | F | Mi | Sol | any | Em |
| Si | Re | any | E7 | Do | Mi | any | C | Re | Fa | any | Dm | Re | Fa | any | G7 |
| Do | Re | M | F | Re | Mi | Dm | G7 | Mi | Sol | any | Am | Re | Mi | any | E7 |
| Do | Re | any | Dm | Re | Mi | any | Em | Do | Sol | any | Am | Mi | La | any | E7 |
| Sol | Do | any | F | La | Do | any | C | Do | Re | any | F | Sol | La | any | Em |
| Sol | La | any | Dm | La | Mi | any | C | Si | Do | Am | F | Do | Re | M | G7 |
| Re | Mi | any | Dm | La | Si | any | G7 | Si | Do | C | F | Do | Re | m | E7 |
| La | Mi | any | F | La | Re | any | G7 | Si | Do | any | Am | Do | Re | any | G7 |
| Sol | Re | any | Dm | Do | Re | any | C | Re | Mi | any | Am | Re | La | any | G7 |
| Do | Mi | any | F | Si | Do | any | C | Mi | Fa | any | Am | Do | Mi | any | E7 |
| Sol | Si | any | Gm | Mi | Fa | any | C | Re | Sol | any | Am | Do | Sol | any | G7 |
| La | Si | any | Dm | Do | Fa | any | F | Fa | Sol | M | F | Do | La | m | E7 |
| Sol | Mi | any | C | La | Fa | N·L | G7 | Fa | Sol | any | Dm | Do | La | any | Am |
| Sol | Mi | any | C | La | Fa | any | F | Si | Sol | N·L | Am | Mi | Fa | any | E7 |
| Si | Mi | any | E7 | Fa | Fa | any | G7 | Si | Sol | any | Em | Fa | Fa | any | G7 |
| Si | Do | any | G7 | | | | | Si | Re | any | Dm | | | | |
| | | | | | | | | Si | Fa | any | G7 | | | | |
| | | | | | | | | Si | Mi | any | Am | | | | |

FIG. 34

| CHORD CHANGING TABLE | | | | | | | |
|---|---|---|---|---|---|---|---|
| NI | DO | Re | Mi | Fa | Sol | La | Si |
| CHANGING CHORD | C | G7 | C | F | G7 | F | G7 |
| | Am | Dm | Am | Dm | C | Am | E7 |
| | F | E7 | Em | G7 | Em | Dm | Em |
| | Dm | D7 | E7 | E7 | Am | C | B7 |

| | | | | | | | | | | | | | |
|---|---|---|---|---|---|---|---|---|---|---|---|---|---|
| D | DUMMY | La | D | La | La | Fa# | La | D | Si | La | Fa# | A7 | Fa# |
| Mi | A7 | Fa# | Mi | La | D | La | La | Fa# | La | D | Si | La | Fa# |
| A7 | Mi | Fa# | Mi | D | Re | La | D | La | La | Fa# | La | La | D |
| Si | La | Fa# | ⇩ Em | Fa# | Mi | A7 | Fa# | Mi | La | D | La | La | Fa# |
| La | La | D | Si | Si | La | La | Fa# | A7 | Mi | Fa# | Mi | D | Re |
| D | Re | Re | Fa# | La | D | Re | G | Si | Si | Re | Si | D | La |
| Fa# | Sol | D | La | La | Fa# | Fa# | La | La | D | Si | La | Fa# | A7 |
| Mi | Fa# | Sol | Fa# | Mi | Mi | D | Re | (END) | | | | | |

FIG. 35

FIG. 38

| | | | | | | | | | | | | | |
|---|---|---|---|---|---|---|---|---|---|---|---|---|---|
| D | DUMMY | La | D | La | La | Fa# | La | D | Si | La | Fa# | An | Fa# |
| Mi | A7 | Fa# | Mi | La | D | La | La | Fa# | La | D | Si | La | Fa# |
| A7 | Mi | Fa# | Mi | D | Re | La | D | La | La | Fa# | La | La | Bm |
| Si | La | Fa# | E7 | Fa# | Mi | A7 | Fa# | Mi | La | D | La | La | Fa# |
| La | La | D | Si | Si | La | La | Fa# | A7 | Mi | Fa# | Si | D | Re |
| D | Re | Re | Fa# | La | D | Re | G | Si | Si | Re | Si | A7 | La |
| Fa# | Sol | D | La | La | Fa# | Fa# | La | La | D | Si | La | Fa# | A7 |
| Mi | Fa# | Sol | Fa# | Mi | Mi | D | Re | (END) | | | | | |

AUTOMATIC ACCOMPANIMENT GENERATING APPARATUS

BACKGROUND OF THE INVENTION

The invention relates to an automatic accompaniment generating apparatus which can automatically add an accompaniment for a melody stored in a memory.

Recent improved electronic keyboard musical instruments employ various automatic accompaniment systems having a commonly termed "easy play" function to help performance by beginners or by performers who are not trained to play so much. One of such systems permits producing accompaniment by operating a small number of keys or buttons with the left hand while producing melody with the right hand. As the accompaniment keys or buttons are operated, given accompaniment chord sound or arpeggio sound is produced. In this system, chord progress data is recorded in a memory in advance, and continuous accompaniment is automatically produced in accordance with the chord progress while the performer plays, with his right hand, only the melody to the accompaniment.

In any of these prior art systems, however, the performer must input chord progress data to the system. In other words, the performer has to have knowledge of chord patterns and chord theories in order to be able to obtain sufficient accompaniment. Accordingly, a beginner who cannot understand the chord patterns or chord theories can produce only simple or monotonous melody with one finger. In other words, the beginner can never sufficiently enjoy music with an electronic musical instrument.

Further, for music fans who have not been familiar with music from childhood, the theories of chords are complicated and difficult to understand, and considerable training is required in order to be able to produce accompaniment as soon as a melody is given.

In fact, many of those who play the guitar, piano and the like cannot perform any piece of music unless there is a score showing a chord progress, thus restricting the repertory of the performer.

SUMMARY OF THE INVENTION

An object of the invention is to provide an automatic accompaniment generating apparatus, which can automatically generate accompaniment such as chord sounds for a melody by merely inputting melody data of a music number.

According to the invention, the above object is achieved by an automatic accompaniment generating apparatus, which comprises a memory for storing tone data, input means for writing a plurality of tone data indicative of the pitch and duration of tones forming the melody of a music number into the memory, and a logic circuit means for forming accompaniment data according to the input tone data.

BRIEF DESCRIPTION OF THE DRAWINGS

FIGS. 8 to 13 are views showing binary codes of various data of melody and chord to be stored;

FIG. 14 is a view showing the relation of the maximum record lengths of melody and chord to tempo clock pulse;

FIG. 15 is a view showing binary codes of tone duration;

FIG. 16 is a view showing an arrangement of the melody data stored in the memory;

FIG. 20 is a view showing the relation of the last note in a number and keys;

FIG. 21 is a view showing six keys used in six scales applicable to a number which terminates with "do";

FIG. 22 is a view showing the total tone duration of various notes in an exemplary number;

FIG. 25 is a table for conversion of the absolute notes in each key to those in the C major scale;

FIGS. 26, 27, 28A, and 28B are views showing chord selection tables;

FIG. 34 is a view showing a chord change table;

FIGS. 35 to 38 are views for explaining a manner of chord change data.

DETAILED DESCRIPTION OF THE PREFERRED EMBODIMENTS

The following embodiments of the automatic accompaniment generating apparatus according to the invention all concern portable electronic musical instruments, but it is to be understood that the invention may also be applied to various other electronic musical instruments.

Figure 1:
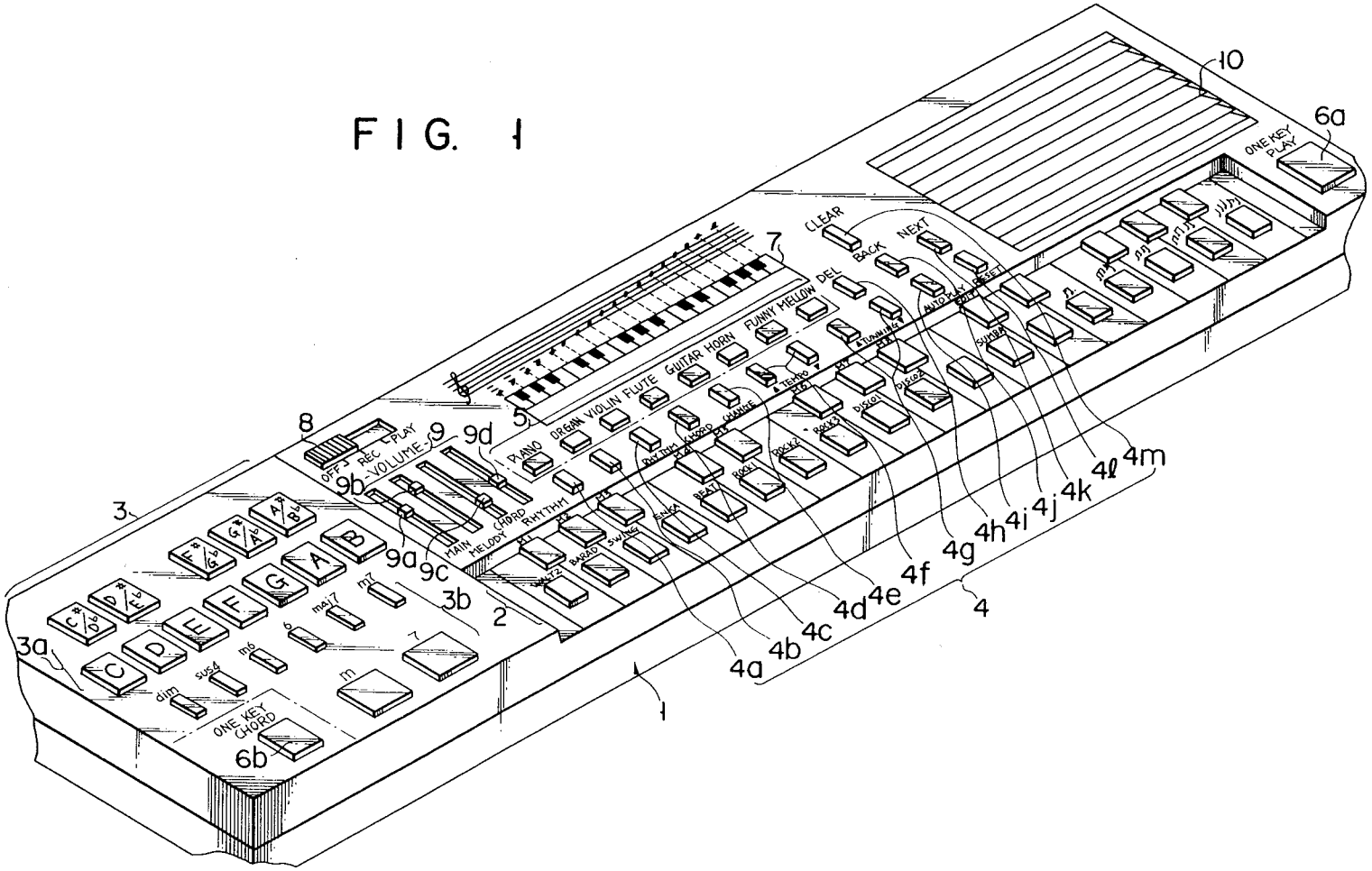
FIG. 1 is a perspective view showing a portable electronic musical instrument incorporating an embodiment of the invention.

Referring now to FIG. 1, there is shown a portable electronic musical instrument having a casing 1. A play or performance key group 2 consisting of thirty one keys is provided on a forward portion of the top of the casing 1. A chord selection key group 3 is provided on the left hand side of the performance key group 2. Rearwardly of the performance key group 2, there are provided a control key group 4 for automatic performance of a music number, the data of which is stored in a memory, and a tone color selection key group 5 for selecting desired tone colors. The thirty one keys in the performance key group 2 are arranged in two rows. Adjacent to the opposite ends of a forward portion of the top of the casing 1 are provided one-key play buttons 6*a* and 6*b* for providing desired time lengths or duration for the tones and chords written in the memory. Program data including tone data for tones and chords, obtained by operating the keys as noted above, are displayed on a display section 7 which includes a liquid crystal panel. A mode selection switch 8 is provided for setting a power "off" mode (OFF), a play mode (PLAY) and a record mode (REC). A volume control switch group 9 is provided for controlling the volume of the tones to be sounded from a sounding section 10. In the casing 1, electronic circuit means which constitutes an embodiment of the automatic accompaniment generating apparatus according to the invention is accommodated as well as a loudspeaker (to be shown later) and a power supply battery. The performance key group 2 cooperates with the control key group 4 for effecting such functions as memory designation, rhythm pattern designation, and accompaniment arpeggio pattern designation. Some of the keys in the rearward row which correspond to black keys are provided with an automatic accompaniment memory editing function. More particularly, in the instant embodiment the memory can be divided into eight divisions that serve as independent memories when it is used for automatic performance. The same memory division or unit memory may be used for repetitive portions of the performance when programming the sequence of performance in the memory.

In the performance key group 2, the keys in the forward row which correspond to white keys in a keyboard are operative to select one of twelve rhythm patterns accompanied with rhythmic chords such as waltz, ballad, swing, enka, 16 beat, rock 1 to rock 3, disco 1 and disco 2, bossa nova and samba or one of six rhythms with arpeggio chords, in which dispersed chords are produced in patterns like those shown with the notes illustrated near the performance key group 2.

The volume control switch group 9 has four levers 9*a* to 9*d* for controlling the overall volume, the volume of melody, the volume of chord and the volume of rhythm respectively.

The name and function of the individual keys in the control key group 4 are as follows.

4*a*: memory key—To let the numbers of the eight memory divisions or units be selected with some of the black keys in the performance key group 2.

4*b*: synchro start key—To synchronize chord sound and rhythm.

4*c*: rhythm key—To select the rhythm patterns with some of the white keys in the performance key group 2.

4*d*: chord key—To add accompaniment chord to the music data stored in the memory. This key serves a most important role in the instant embodiment.

4*e*: change key—To change a chord added by automatic chord addition.

4*f*: tempo key—To vary rhythm tempo.

4*g*: tuning key—To vary scale by semitones.

4*h*: delete key—To delete some of note data stored in the memory.

4*i*: auto-play key—To cause automatic performance of the music data stored in the memory.

4*j*: back key—To backwardly shift tone data stored in the memory step by step.

4*k*: next key—To forwardly shift tone data stored in the memory step by step.

4*l*: reset key—To stop automatic performance and indent the stored music data.

4*m*: clear key—To clear the memory.

The chord selection key group 3 includes a root selection key group 3*a* and a scale selection key group 3*b*, these key groups 3*a* and 3*b* consisting of respective keys arranged in the form of keyboards. These key groups permit selection of nine different chords, i.e., the major (M), the minor (m), the seventh (7), the minor seventh (m7), the major seventh (maj7), the sixth (6), the minor sixth (m6), sus 4 and the diminish (dim) for each of twelve different roots that is, a total of $12\times9=108$ different kinds of chords can be selected.

The tone color selection key group 5 consists of eight keys which can select respective tone colors, i.e., those of the piano, the organ, the violin, the flute, the guitar, the horn, the funny and the mellow.

The circuit construction of this embodiment of the portable electronic musical instrument will now be described. Of the circuit, only the parts which have direct bearing on the invention will be described.

Figure 2:
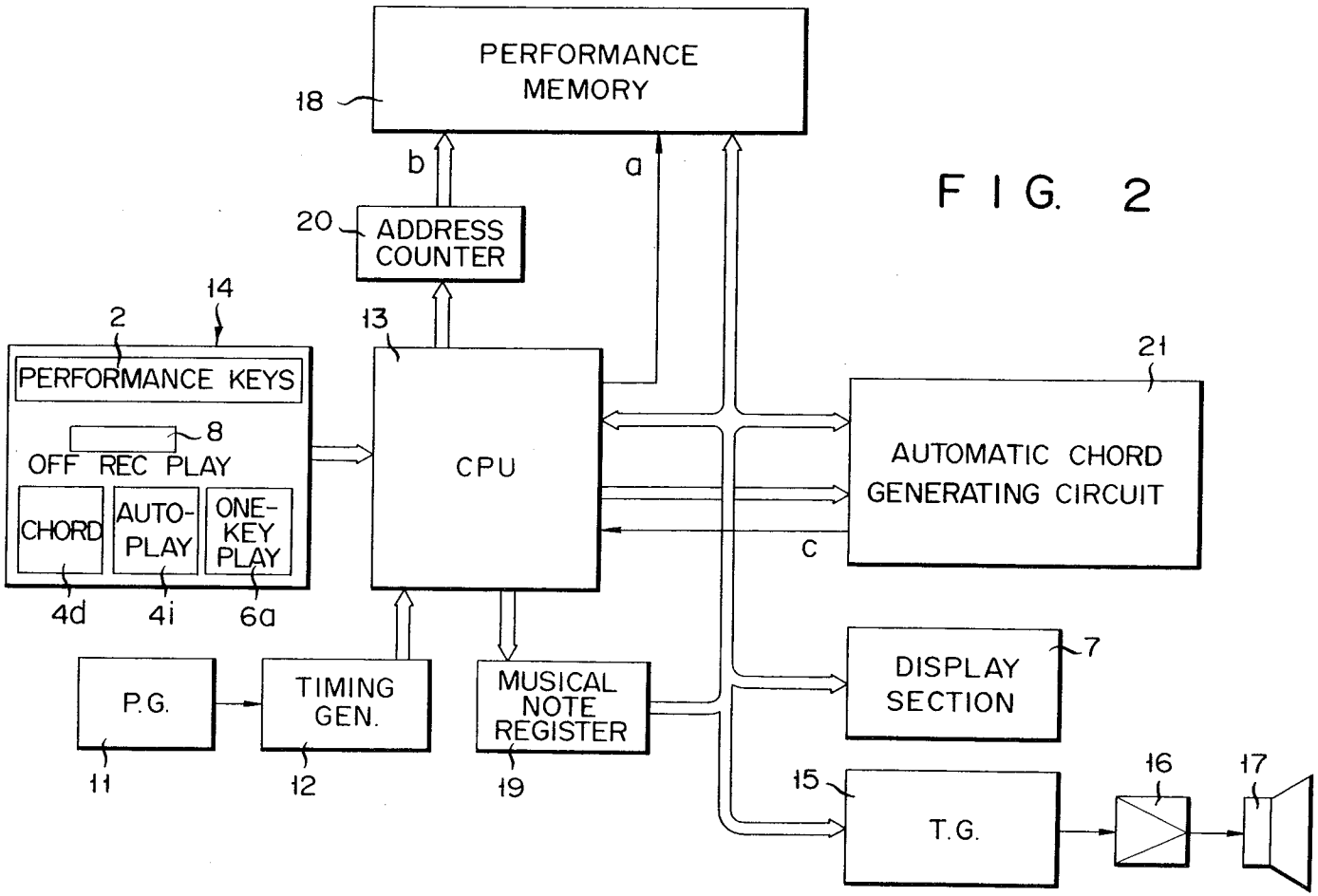
FIG. 2 is a block diagram showing the circuit construction of the electronic musical instrument shown in FIG. 1.

FIG. 2 is a block diagram showing the embodiment of the automatic accompaniment generating apparatus for the portable electronic musical instrument. A pulse generator 11 provides a pulse signal of a predetermined frequency. This pulse signal is frequency divided in a timing signal generator 12 to produce various timing signals such as tempo clock and those necessary for tone generation, these signals being supplied to a central processing unit (hereinafter referred to as CPU) 13. The CPU 13 is, for instance, a one-chip microprocessor, which controls all the operations of the portable electronic musical instrument such as sounding, recording, automatic chord generation and automatic performance. A key input section 14 includes the performance key group 2, chord key 4*d* and one key play key 6*a* noted above. For manual performance, the mode selection switch 8 is set to the play mode. By operating the performance key group 2 with the mode selection switch 8 in this position, sounding command data is supplied from the CPU 13 to a tone generator 15. The tone generator 15 produces corresponding tone signals which are amplified in an amplifier 16 and then coupled to the sounding section 10 noted above to be sounded from a loudspeaker 17.

A performance memory 18 consists of a RAM (random access memory), in which a melody and chords can be stored in formats to be described later. Melody data to be manually recorded in the performance memory 18 is first supplied from the CPU 13 to a note register 19 and then successively written in areas designated by an address counter 20.

An automatic chord applying or generating circuit 21 constitutes a substantial part of the embodiment.

Figure 3A:
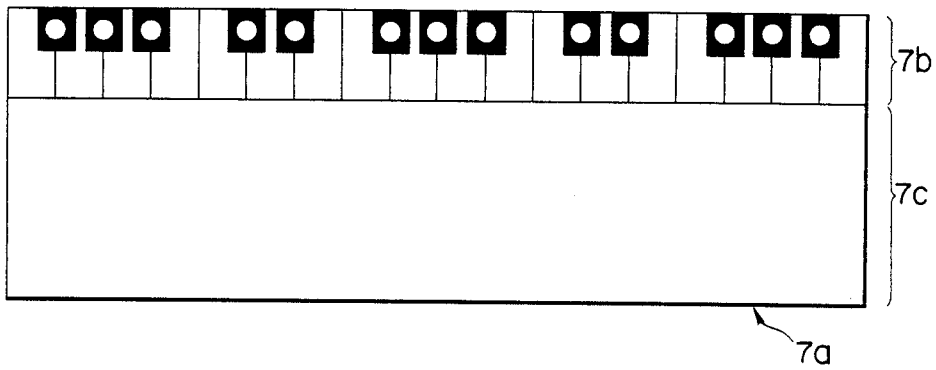
FIG. 3A is a plan view showing a display panel when electric power is "off"
Figure 3B:
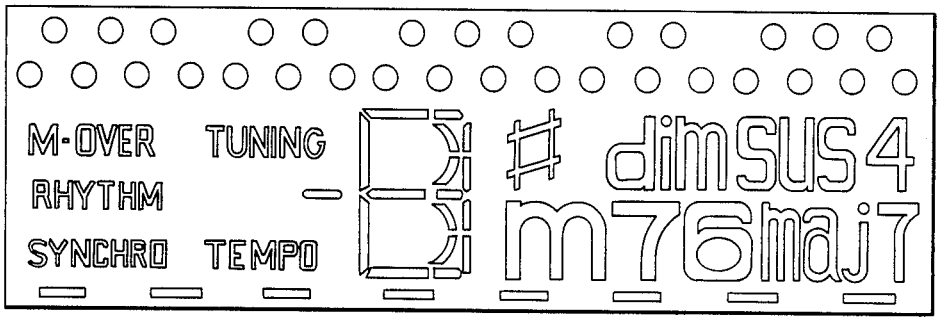
FIG. 3B is a plan view showing the structure of display segments of a display panel.
Figure 3C:
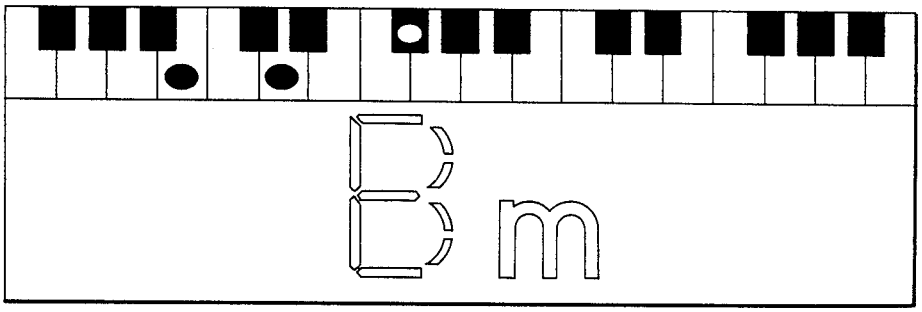
FIG. 3C is a view showing the display panel in a displaying state.

FIG. 3A shows a liquid crystal display panel *7a* which constitutes an essential part of the display section 7. The liquid crystal display panel *7a* includes a note display section *7b* having a keyboard-like form and a character display section *7c* extending on the forward side of the section *7b* for displaying chord and other music data. FIG. 3B shows the display segment structure of the liquid crystal display panel *7a*. The individual display segments can be on-off operated to display the notes of melody, name of chord, chord position, tuning level, tempo level, synchro start, rhythm status that is set, memory over, etc. For example, when a chord Bm is selected by operating the chord selection switch group 3, while the sounds of bass and three notes of the chord Bm are produced, the chord designation "Bm" is displayed in the character display section *7c* and the chord position in the note display section *7b*.

Figure 4:
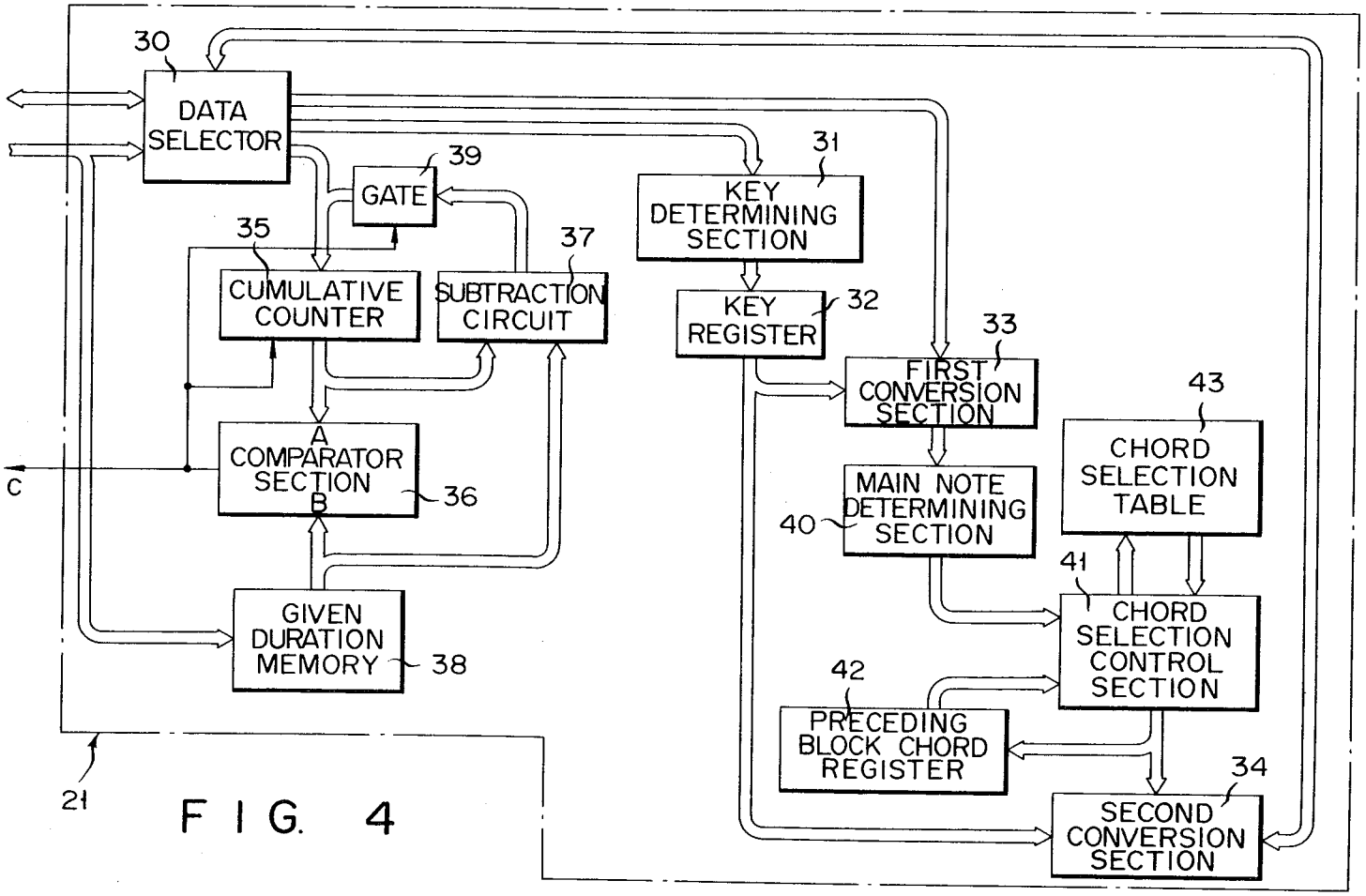
FIG. 4 is a block diagram showing the detailed construction of an automatic chord generating circuit in FIG. 2.

The construction of the automatic chord generating circuit 21 will now be described in detail with reference to FIG. 4. When a chord generation command is transmitted to the CPU 13 in response to the operation of the chord key *4d*, the CPU 13 reads out the last tone stored in the performance memory 18. The last tone read out is transferred through a data selector 30 to a key determining section 31. The key determining section 31 determines the sort of key of a number performed in accordance with a flow chart to be described later. The data of the determined key is transferred through a key register 32 to a first conversion section 33 and a second conversion section 34.

In this embodiment, chords are provided for divisions of a melody each corresponding to the duration of two crotchets, e.g., a half bar. More particularly, as successive notes are read out from the performance memory 18, they are transferred through the data selector 30 to a cumulative counter 35. The counter 35 accumulates the durations of the transferred notes and provides accumulated duration data A to a comparator 36 and also to a subtracter or subtraction circuit 37. In addition to the accumulated duration data, a preset duration or time length data B is supplied from a preset time length or given duration memory 38 to the comparator 36 during a predetermined period of time, during which duration data for a predetermined block length (for two crotchets in this embodiment) is set by the CPU 13. The comparator 36 compares the magnitudes of the data A and B, and when a condition $A \geqq B$ is met, it provides a command signal. This command signal is transferred as a chord generation command signal c to the CPU 13. It is also fed to the reset terminal of counter 35 to reset the same. It is further fed to a gate circuit 39 to render the same ready to be opened. The accumulated duration data A and predetermined duration data B are also fed to the subtracter 37. The subtracter 37 effects subtraction of data B from data A and supplys the result to the gate circuit 39. If some notes stride a borderline between adjacent blocks of data, the overflow portion of the note duration is supplied as the first duration data of the next block to the counter 35.

When the CPU 13 receives the chord generation command signal c from the comparator 36, it transfers one or more notes in the pertaining block through the data selector 30 to the first conversion section 33. In this embodiment, notes of a number of any key are converted such that all the converted notes are related to C major (C) or A minor (Am). The first conversion section 33 shifts the transferred note toward ascending octaves by the interval of semitones between the root and C in case of the major key, and by the interval of semitones between the root and A in case of the minor key. A key tone or main note determinig section 40 determines the note (referred to as N1) of the longest duration among the transferred notes and transfers it together with the other notes to a chord selection control section 41. Previous block chord data, which is obtained from a preceding block chord register 42, is fed back to the chord selection control section 41.

The chord selection control section 41 reads out, according to the transferred tone data and previous block resultant chord data of the preceding block, the result chord to be generated for the instant block from a chord selection table 43 consisting of a ROM. The result chord read out is fed to the preceding block chord register 42 and also to the second conversion section 34. The chord selection table 43 consits of three different tables for respective situations to be shown later in detail according to the number of notes (either one, two or three or more notes) contained in the block. In case of a block containing two notes, the chord selection control section 41 selects a note, the duration of which is next to that of N1. In case of a block containing three or more notes, the section 41 selects two notes as determined by a table. According to these notes and also to the preceding block chord, the chord selection control section 41 reads out the result chord.

The second conversion section 34, to which the key data is fed from the key register 32 as mentioned earlier, shifts the root of the result chord that is transferred from the chord selection control section 41 toward the descending octaves by the interval of semitones, by which the shift has been done toward the ascending octaves in the first converting section. The shifted result is fed to the data selector 30. More particularly, the note transferred to the first section 33 is changed to a note in C major (C) or A minor (Am), and the result chord is re-converted to recover the original chord. This result chord is transferred from the data selector 30 to the CPU 13. The CPU 13 writes the result chord data into the performance memory 18 as note groups each of a predetermined block length.

Figure 5:
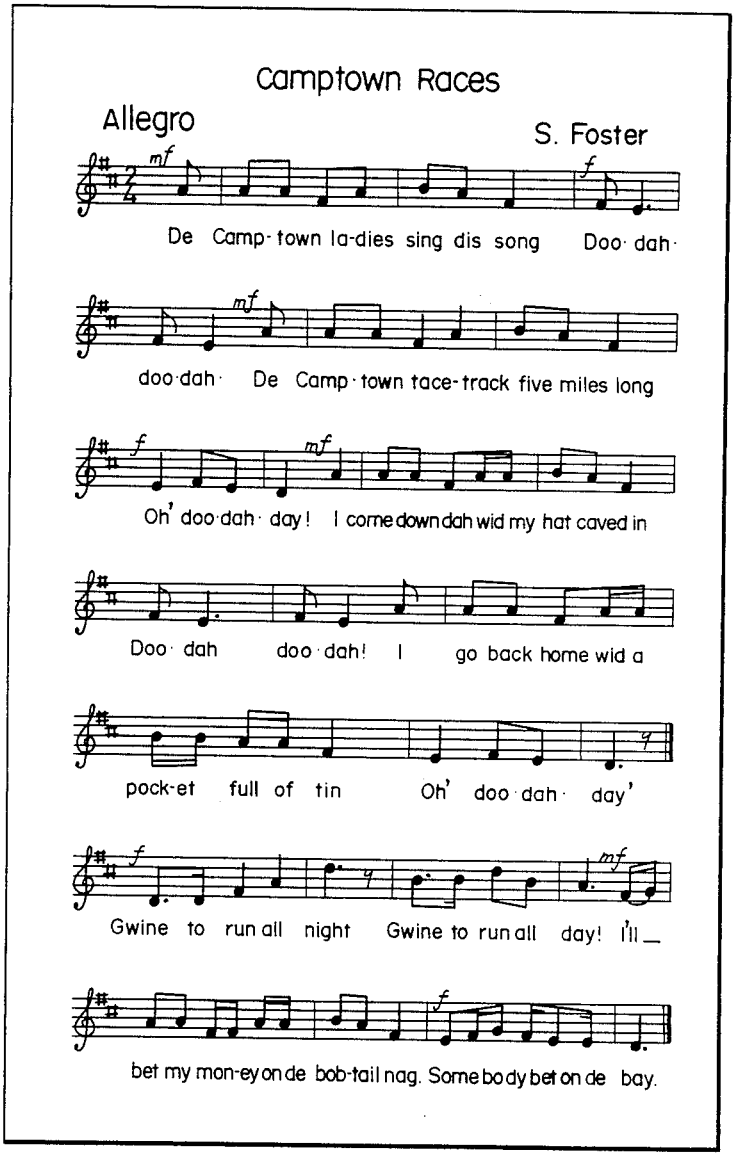
FIG. 5 is a view showing a score for "Camptown Races" by S. Foster.

The operation of this embodiment of the automatic chord generating apparatus will now be described in connection with a case of automatically obtaining accompaniment chords for an actual number. FIG. 5 shows a score of melody lines of "Camptown Races", a famous number by S. Foster which is popular as an American folk song. For generating accompaniment chord data automatically to the melody data of this number with an electronic musical instrument employing this embodiment, the mode selection switch 8 is first set to the record mode position (REC). Then, the memory key *4a* is operated, and then one of the eight memories is selected by operating the corresponding one of the rearward black keys. It is now assumed that a memory M1 is selected. The memory M1 is reset or cleared by operating the clear key *4m*, and then the notes of the melody are written in the performance memory 18 using the performance key group 2 without any regard to tone duration. The memories M1 to M8 each have a capacity of 254 digits (each digit consisting of 4 bits). As soon as overflow occurs in the memory M1, the memory M1 is automatically replaced with the memory M2 so that recording is done continuously.

Figure 6A:
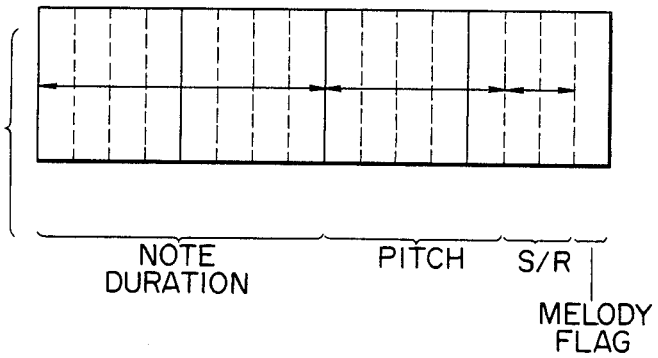
FIG. 6A is a view showing the format of melody data stored in a memory.
Figure 6B:
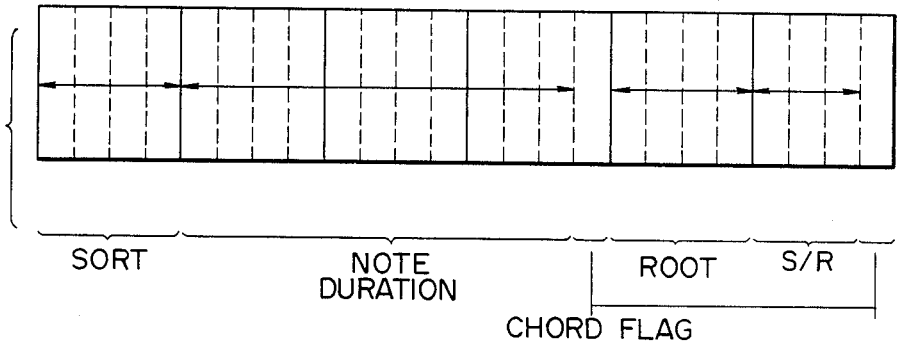
FIG. 6B is a view showing accompaniment chord data stored in a memory.

The melody and chord data to be written in the performance memory 18 are of the formats as shown in FIGS. 6A and 6B. The melody data format as shown in FIG. 6A consists of 16 bits, i.e., 4 digits. Of these bits, the first 8 bits represent the tone duration. The following 5 bits represent the note. The following 2 bits represent the ratio between the key "on" period and key "off" period, i.e., the ratio S/R of the sustain S to release R. The last one bit represents a melody flag for distinguishing melody from chord. The chord data format as shown in 6B consists of 24 bits, i.e., 6 digits. Of these bits, the first 4 bits represent the sort of keys such as minor or seventh to which the chord is related. The following 11 bits represent the duration. The following one bit and the last one bit are chord flags for distinguishing chord from melody. The following 4 bits represent the root of the chord. The 3 bits preceding the last bit represent the ratio S/R noted above. The two chord flags are provided in the chord data in order that a flag may occur at the same position when the data in the performance memory 18 is read out either from the first address side or from the last address side, i.e., in order to prevent otherwise possible erroneous operation in the read mode.

Figure 7:
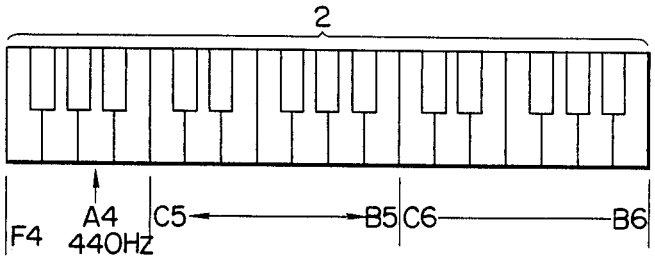
FIG. 7 is a view showing a compass of a group of performance keys when a tone color of a piano is selected.

The form of recording various data will now be described. When a tone color of a piano is designated, the compass of the key group 2 corresponds to F4 to B6 as shown in FIG. 7 in the "0" tuning level. The 31 different notes are represented by respective 5-bit data as shown as the last note in FIG. 8. The dummy shown in FIG. 8 represents the beginning of a number and does not represent any note. FIG. 9 shows the note and chord flag codes. The S/R data are as shown in FIG. 10. These data may also be as shown in FIG. 11. FIG. 12 shows root codes. FIG. 13 shows codes of chords. FIG. 14 shows the maximum record lengths of melody and chord at the standard tempo level. At this time, the unit of the basic tempo clock $\phi$ for rhythm generation provided from the timing signal generator 12 is 25 msec. When the basic tempo clock has been counted for 8 bits (i.e., 256 times), the maximum record length of 6.4 sec. (i.e., 2 bars) of melody is reached. When the basic tempo clock has been counted for 11 bits (i.e., 2,048 times), the maximum record length of 51.2 sec. (i.e., 16 bars) of chord is reached. The standard tempo is designated as ♩=74 on the score. FIG. 15 shows tone duration codes. For example, a quaver, which corresponds to 16 basic tempo clock pulses, i.e., 0.4 sec., is represented as "00010000".

Figure 17:
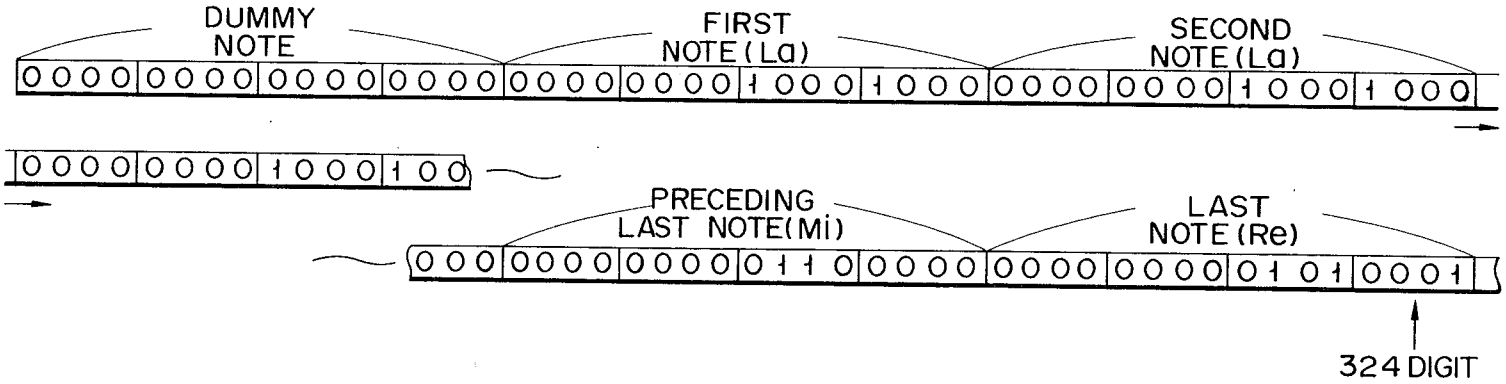
FIG. 17 is a view showing binary code record for a first portion and a least portion of the melody data shown in FIG. 16.

The data of the melody of "Camptown Races" stored in the performance memory 18 by operating the play key group 2, has an arrangement as schematically shown in FIG. 16. FIG. 17 shows a binary code version of the data of FIG. 16 with an intermediate portion of the number omitted. In this stage, the tone duration has not been set yet. That is, all the duration codes are "0" data. Further, since 81 notes of melody have been recorded, 324 digits of memory are filled, i.e., the memory M2 is in use.

Now, the durations are given to the melody. First, the reset key 4*l* is operated to indent the number with the mode selection switch 8 maintained in the record mode position (REC). Then, by operating the one-key play key 6*a* to follow the actual tone durations on, for instance, march, the durations thus provided are inserted as the duration data to the melody data in the performance memory 18 while the melody is read out and sounded. In this case, if the beginning of the number is an up beat start, the dummy note is recorded for the duration of the first rest in the first bar. After the performance of the number is completed, the chord key 4*d* is operated, whereby automatic chord generation is executed by the automatic chord generating circuit 21.

Figure 18:
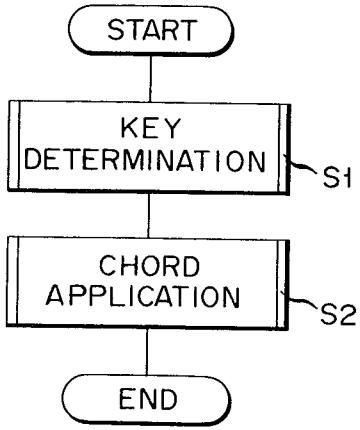
FIG. 18 is a flow chart for explaining the general operation of automatic chord generation.
Figure 19:
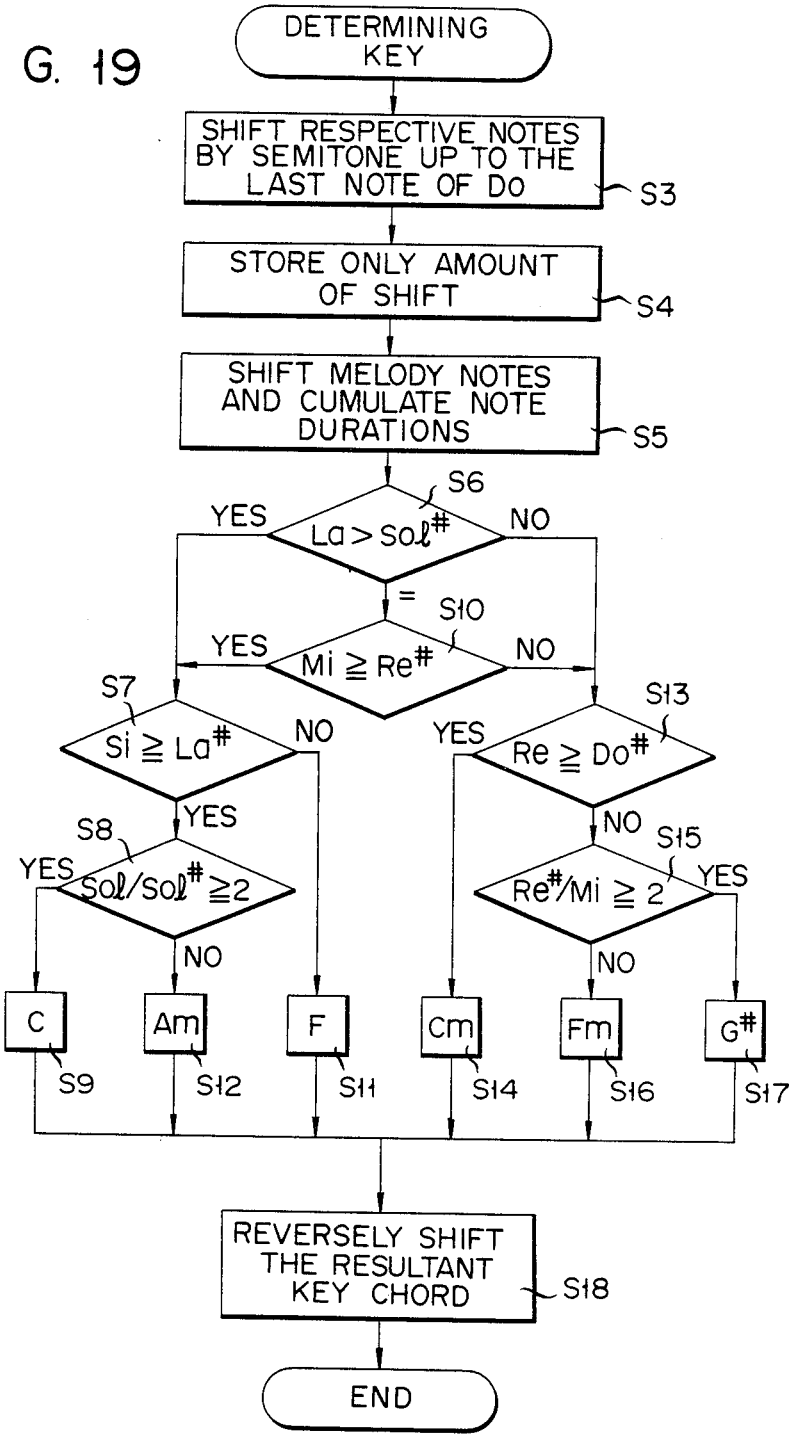
FIG. 19 is a flow chart of a sub-routine for determining keys of a number.

The operation of the automatic chord generating circuit 21 will now be described in detail. FIG. 18 shows the general flow of the automatic chord generation carried forth with this embodiment. The process roughly consists of a step S1 of determining the key, and a step S2 of generating chord data. FIG. 19 shows a sub-routine for the key determination. If the recorded number ends in "do", for instance, six different sorts of key containing "do" (i.e., C, Am, F, Cm, G# and Fm) are conceivable as the key of the number. Of these, C and Cm are complete termination, while the other four keys are incomplete termination. Most of the numbers are of the former two sorts of key. Likewise, if the last tone of a number is "re", six different keys containing "re" (i.e., D, Bm, G, Dm, A# and Gm) are conceivable. If the last tone is "sol", keys containing "sol" (i.e., G, Em, C, Gm, D# and Cm) are conceivable. These relations are shown in FIG. 20. It will be seen that whatever note is the last tone of a number, the conceivable sorts of key are obtainable by shifting those containing "do" by semitones corresponding to the difference interval. For example, the conceivable keys in case where the last note is "sol", are those obtainable by shifting the six keys containing "do" by an interval of 7 semitones. Accordingly, in this embodiment, the notes of a number having any last note are shifted to those which can be dealt with in the same way as the notes of a number in which the last note is "do".

In the instant case, when the chord key 4*d* is operated, the CPU 13 reads out the last note "re" from the performance memory 18 and transfers it to the key determining section 31. The key determining section 31 shifts the note "re" toward ascending octaves by semitones up to "do" in a step S3, the shift here being represented as D→D#→E→F→F#→G→G#→A→A#→B→C. The section 31 then stores the number of shift steps (here 10 steps) in a step S4. The CPU 13 then reads out all the notes from the performance memory 18 and transfers them to the key determining section 31. The key determining section 31 executes a step S5, in which the section 31 shifts the individual input notes to the extent corresponding to that mentioned above and accumulates the durations of the individual notes. In this accumulation, "la", for instance, is dealt with as "sol", "fa#", for instance, as "mi", and so forth.

FIG. 21 shows the notes used in the six different keys selected in case where the last note is "do". In the Figure, the arrow and dashed circle marks represent the case where the pertaining note is sometimes changed as shown. The steps S6, S7, S8, S10, S13 and S15 in the key determination sub-routine have the function of approximating individual accumulated notes to those in the six different keys. For example in the C and F keys the same notes are used except for that the former key uses "si" while the latter uses "la#". In the C and Am keys, basically the same notes are used. However, in numbers composed in Am the note "sol#" is used comparatively frequently but not so frequently as in numbers in C, so that in the case of the Am key double the total duration occupied by "sol#" is compared with the duration occupied by "sol".

FIG. 22 shows the total durations of notes obtained as a result of shifting toward ascending octaves by 10 semitones and subsequent accumulation. In the flow chart of FIG. 19, through the steps S6, S7, S8 and S9 the C key is chosen. In case it is determined in the step S6 that "la" and "sol#" have an equal duration or both of them are not present, a step S10 is executed, in which the durations occupied by "mi" and by "re#" are compared.

In case of a number other than the instant number, the F key is chosen in a step S11 if NO yields in the step S7. The Am key is chosen in a step S12 if NO yields in the step S8. The Cm key is chosen in a step S14 if YES yields in a step S13. The Fm key is chosen in a step S17 if NO yields in a step S15. The G# key is chosen in a step S17 if YES yields in the step S15. In the steps S8 and S15 the duration occupied by one of the two notes is compared with double the tone duration occupied by the other, and YES is yielded if both of the notes are absent, as mentioned before.

The key thus selected is that in which the last tone is "do" and is not the true key. In a step S18, the root of the result key tone data is thus shifted toward descending octaves by the same interval as in the previous ascending shift (i.e., by 10 semitones), the shift here being represented as C→B→A#→A→G#→F#→F→E→D#→D. The data of the key determined by the key determining section 31 is accumulated in the key register 32 to be fed to the first and second conversion sections 33 and 34.

Figure 23:
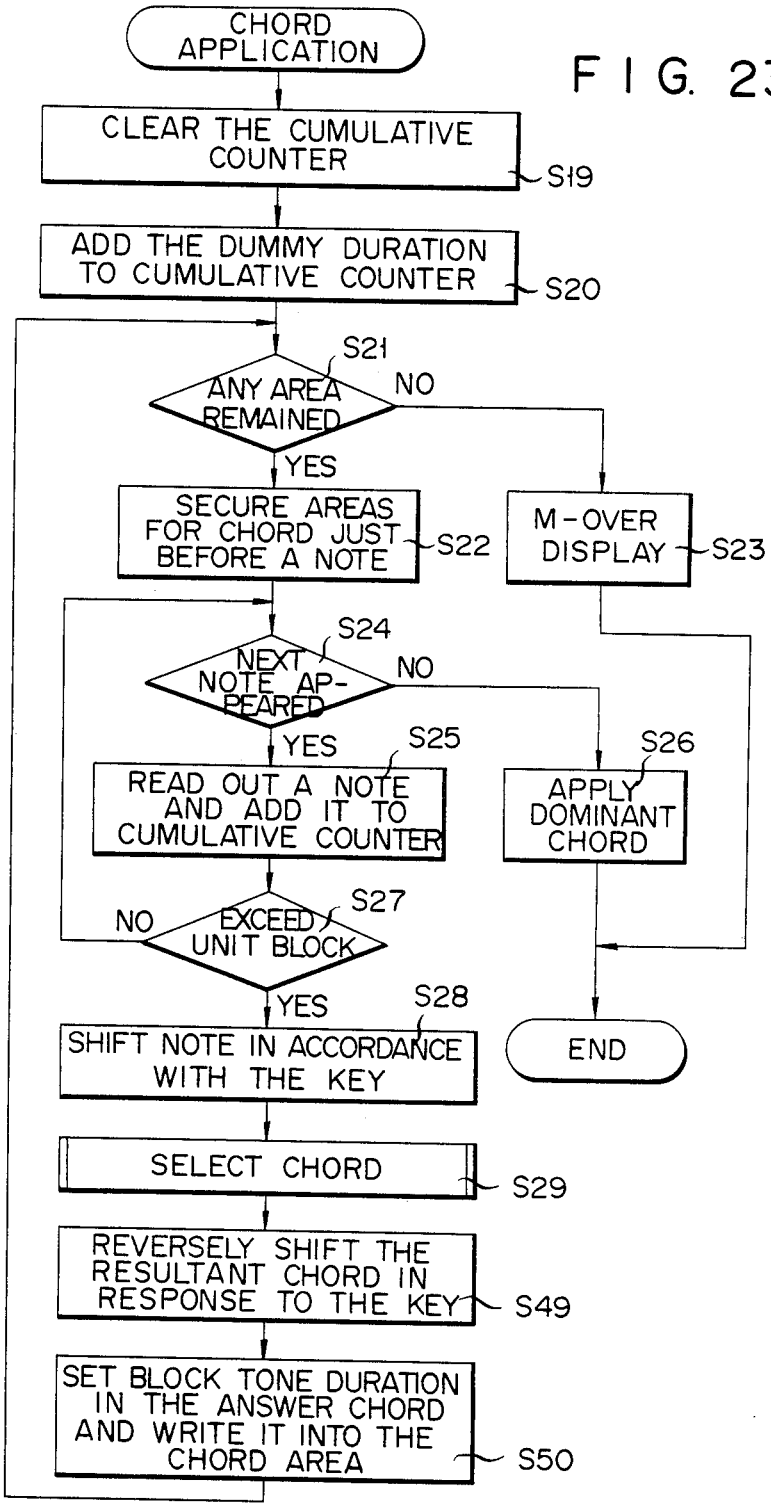
FIG. 23 is a flow chart for explaining a chord generation sub-routine.

When the key determination in the step S1 is completed, the chord insertion in the step S2 is executed. FIG. 23 is a sub-routine for the chord insertion or application. After the key is determined a step S19 is executed, in which the CPU 13 resets the counter 35 by writing zero data into the same. In a subsequent step S20, the duration of the dummy code which has been recorded in the beginning of the number, i.e., in the instant case a length of }. (♩×3=48ϕ) is set in the counter 35. In a subsequent step S21, a check is done as to whether there is a remaining empty memory area of 6 digits necessary for writing chord data in the performance memory 18. If YES yields in the step 21, a step 22 is executed, in which the area for writing chord data is secured by backwardly shifting the whole note data in the performance memory 18 by 6 digits. If it is determined in the step S21 that an empty memory area in excess of 6 digits is not remaining in the performance memory 18, a step S23 is executed, in which "M-OVER" is displayed on the character display section 7C of the display section 7. When this takes place, no further data is written in the performance memory 18, and the operation is interrupted though the chord addition is not completed.

After the step S22, a step S24 is executed, in which the CPU 13 checks whether there is a next note in the performance memory 18. (Here there of course is the next note for it is the first note in the number.) In a subsequent step S25, duration "♩" (16ϕ) of the first note, i.e., "la" is set in the counter 35. When the comparator 36 detects that the relation between the accumulated duration A in the counter 35 and the predetermined duration B corresponding to two crotchets set in the preset duration memory 38 is A≧B, it provides a chord insert command signal C to the CPU 13. At this time, the counter 35 is reset in response to the command signal. This is done because the pertinent notes may stride between adjacent blocks. At the same time, the gate circuit 39 is opened to let the subtraction result A−B obtained in the subtraction circuit 37 be written again in the counter 35. That is, the counter 35 is just reset if A=B. The above operation is done in a step S27.

If it is determined in the step S24 that there is no next note, that is, after the last note is read out, a step S26 is executed, in which the dominant chord (i.e., a chord corresponding to a key) is inserted into a leading portion of the last block. This brings an end to the sub-routine.

With the appearance of the chord generation command signal C from the comparator section 36, the CPU 13 reads out data of a group of notes corresponding to the accumulated duration in the counter 35 (in the instant case of the first block, only the note "la♩") and transfers the data through the data selector 30 to the first conversion section 33.

In the chord insertion in the step S2 in FIG. 18, like the key determination sub-routine in the step S1, all the notes in the number are dealt with as notes in the C major key (or in the A minor key which is a parallel minor key). In a similar concept, if any key is regarded as C or Am, a melody may be interpreted in terms of simple tone designations of "do", "re", "mi", . . . rather than in terms of the absolute note designations. For example, in the F key "fa" is taken as "do", and "fa", "sol" and "la" are taken as "do", "re" and "mi" respectively. This relation is shown in FIG. 25. For example, in the Em key the sound "sol" is taken as "do" as is shown.

The first conversion section 33 executes the conversion of notes as described above; for instance the note "la" transferred to the first converting section 33 is transferred therefrom as the note "sol" to the main note determining section 40. This is done in a step S28, that is, in this step all the notes are shifted toward ascending octaves to an extent corresponding to the interval from D to C, i.e., by 10 steps (see the uppermost and third uppermost rows in FIG. 20).

Figure 24A:
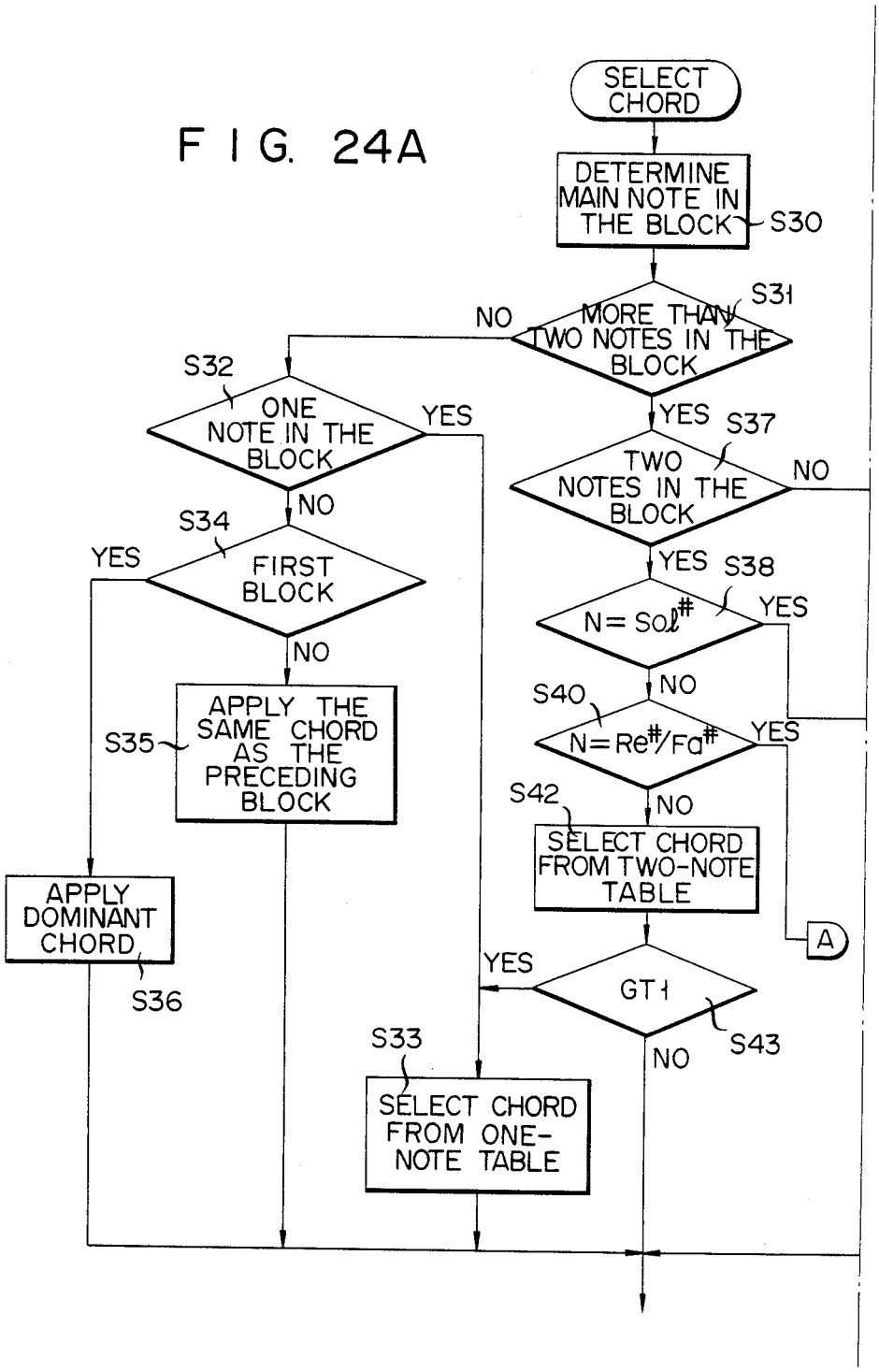
FIGS. 24A and 24B show a flow chart for explaining a chord selection sub-routine.
Figure 24B:
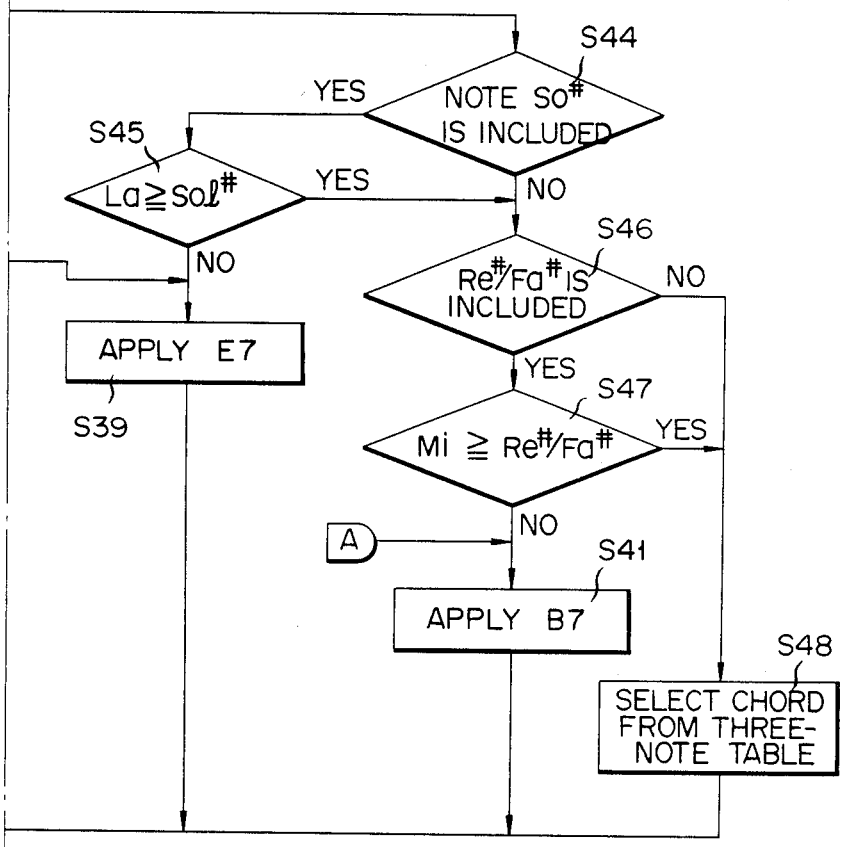

In a subsequent step S29, the chord to be inserted for the note group in each block is selected. This step will be described in detail with reference to the flow chart of FIG. 24. The note "sol" which is provided from the first conversion section 33 as a result of conversion of the first note, is fed to the main tone determining section 40. In this embodiment, the chord selection is done with respect to a note occupying the longest duration in the pertaining block. That is, in a step S30 the main tone determining section 40 compares the accumulated durations of notes involved and transfers the note occupying the longest duration as the main tone (referred to as N2) together with the other note data to the chord selection control section 41.

In the chord selection table 43 three tables respectively for the case where only one note is contained in the block, the case where two notes are contained and the case where three or more notes are contained, are provided. FIGS. 26 to 28 show the tables for these three cases. The chord selection control section 41 determines the pertinent case from the transferred note data and designates the corresponding table in the chord selection table 43. At this time, the previous block chord provided from the preceding block chord register 42 is also used as the data, on the basis of which the chord selection is done. In the above way, a chord to be applied for each block is read out.

If the note "sol" corresponding to the first note as noted above is the sole note in the block transferred to the chord selection control section 41, chord selection is done on the basis of the corresponding table, i.e., the table for the case where only one note is contained in the block, through steps S31, S32 and S33. In the table of FIG. 26 for this case, the notes in the uppermost row are the main notes (N1), and the chords in the left and right columns are the previously selected chords (hereinafter referred to as LC). Necessary chords are read out from this table. Of this table, the left hand half is used in the case of the major key, and the right hand half in the case of the minor key. The designation OTH at the bottom of the LC columns represents other chords. In the instant case, the column for "sol" in the left hand half of the table for the major key is referred to for the first note. At this time, there is no LC because the pertaining block is the first block. Thus, data in the row of OTH is read out, that is, C is selected as the chord to be generated for the first block.

The chord data C thus selected is fed from the chord selection control section 41 to the preceding block chord register 42 and also to the second conversion section 34. The second conversion section 34 then executes a step S49, in which the root of the transferred chord is reversely shifted toward descending octaves by the same interval as that of the shift in the first conversion section, thus recovering the chord in the original scale. More particularly, the note C in this case is shifted toward descending octaves for 10 semitones, the shift here being represented as C→B→A♯→A→G♯→G→F♯→F→E→D♯→D. The resultant key D is transferred through the data selector 30 to the CPU 13. In a subsequent step 50, the chord data for D is written in the previously reserved 6-digit memory area in the performance memory 18, thus completing the chord generation for one block.

In the above way, a chord is written in the performance memory 18 every time the total duration becomes equal to two crotchets (64$\phi$). Now, the remaining part of the flow chart of FIG. 24 will be described. If it is determined in the step S32 that no note is contained in the pertinent block, a step S34 is executed, in which whether the block is the first block is checked. If the block is not the first block, the same chord as for the preceding block is selected in a step S35. It may happen that YES yields in the step S34, indicating that no note is contained in the first block. This may occur due to the following reason. When counting the tone duration, derivative notes other than the notes "do", "re", "mi", "fa", "sol", "la" and "si" are disregarded. If the first block contains only such derivative notes, a dominant chord is selected in a step S36.

If a block contains two notes, the sub-routine goes through a step S37 to a step S38. If YES yields in the step S38, E7 is selected in a step S39. If NO yields in the step S38, the sub-routine goes to the step S40. If YES yields in the step, i.e., N is "re♯" or "fa♯", B7 is selected in a step S41. If No yields in the step S40, a step S42 is executed, in which chord selection is done with reference to the table for the case where there are two notes in a block. The chord selection in this case will now be described in detail with reference to FIG. 27.

When the chord selection control section 41 detects that there are two notes in a block, it selects the corresponding table in the chord selection table 43 and reads out result data on the basis of the note N1 noted above and another note (referred to as note N2). In the table of FIG. 27, like the table for the case where there is only one note in a block, the left half is used for the major key C and the right half for the minor key Am. For example, if the key is Am, N1 is "fa" and N2 is "la", the result chord is Dm. In the table, GT1 denotes a special case where YES yields in a step S43, commanding the reference to the table for the case where there is only one note in a block. Thus, N2 is disregarded, and N1 and the preceding block chord are regarded as factors for the chord selection. For example, in the fourth bar the notes after the conversion are "mi♩" and "re♩" and N1 and N2 are respectively "re" and "mi". Since result in this case is GTI from the left hand half of the table, reference is made to the left hand half of the table in FIG. 26. Here, chords in C are provided in the same way as for the case where there are three or more notes in a block as will be described later. Since N1 is "re" and LC is C, G7 is selected as a result.

The operation in the case where there are three or more notes in a block will now be described. In this case, NO yields in the step S37 so that the sub-routine goes to a step S44. In the step S44, check is done as to whether "sol♯" is contained in the block. If YES yields, the tone time lengths of "sol♯" and "la" are compared in a step S45. If NO yields in the step S45, that is, if the tone duration of "la" is shorter than that of "sol♯", E7 is selected in the step S39 noted above. If YES yields in the step S45, a step S46 is executed, in which check is done as to whether "re♯" or "fa♯" is contained. If YES yields in this step S46 and also if NO yields in a subsequent step S47, that is, if the tone duration of "mi" is shorter than that of "re♯" or "fa♯", a chord in B7 is selected in the step S41 noted above. If NO yields in the step S46 or if YES yields in the step S47, the chord selection is done with reference to the table for the case where there are three or more different tones in a block.

The chord selection with reference to the table of FIG. 28 for the case where there are three or more notes in a block is based on the following rules. If N1 is "do", for instance, the chord selection control section 41 scans the column for "do" from the first or uppermost member, and a chord is selected in a place where two notes are found as accompanying tones (referred to as N3 tones) among the tones other than N1 in the block. In this case the duration of N3 is disregarded, and only whether N3 is present is taken into consideration. For two to four lines in which the N3 tones are recorded, the previous block chord (LC) is taken into consideration. In the LC column, "M" means any major chord, and "m" means any minor chord. The designation "any" has the following meaning. If there are a plurality of result chords with respect to an N3 tone set, then "any" in the last member of the column means "any chord other than the chords noted above". If there is only one result chord with respect to a N3 tone set, "any" means "any chord". The designation "fa fa" in the last member in the column for "do" means any chord in case when "fa" is contained in other combinations than those in the upper members where "fa" is contained. The designation "N1L" means the case where the tone duration of N1 occupies more than one half in a block. Thus, in the third bar, for instance, the individual notes after the conversion are "ra♩", "so♩" and "mi♩", and N1 is "mi". In the tenth member in the column for "mi", LC is "M" (which means that the chord for the previous bar is C as determined from the table for the case where there are two notes in a block).

Thus, C is read out as the chord for the instant bar (the chord being referred to as PC).

In the main note determining section 40, if the notes in a block are all of an equal tone duration, the first note is made to be N1, and also if two notes are contained in the block another note of an equal tone duration is made to be N2 in the chord selection control section 41.

Figure 29:
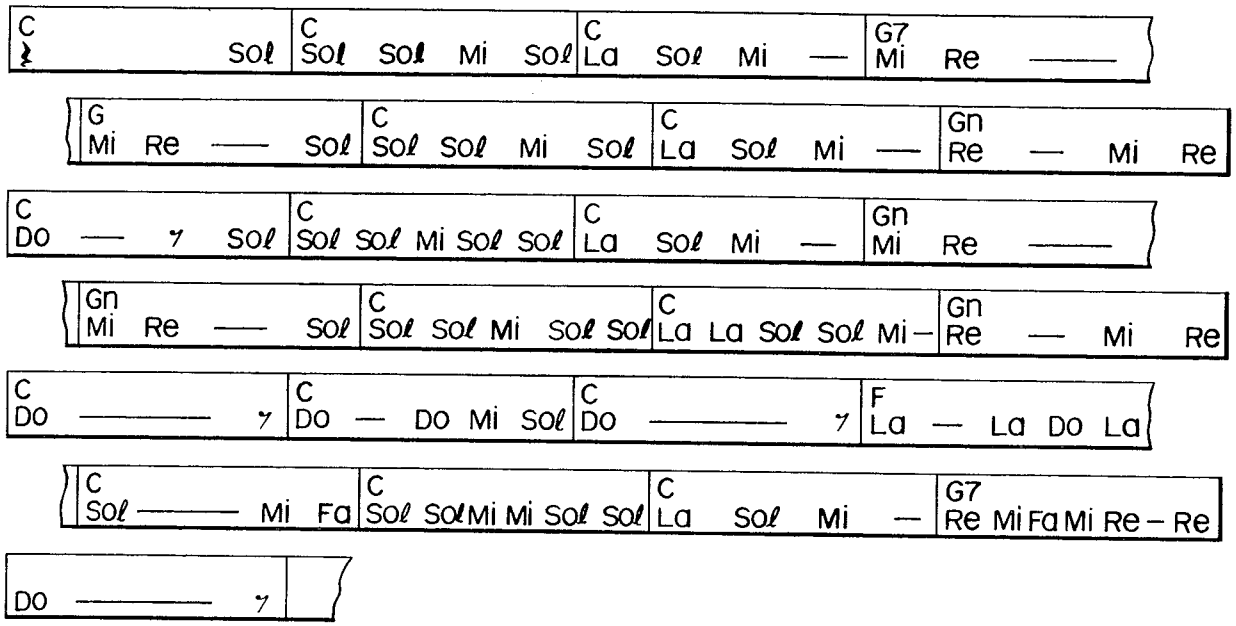
FIG. 29 is a view for explaining the conception of a chord generation as to a melody for each bar in C major.
Figure 30:
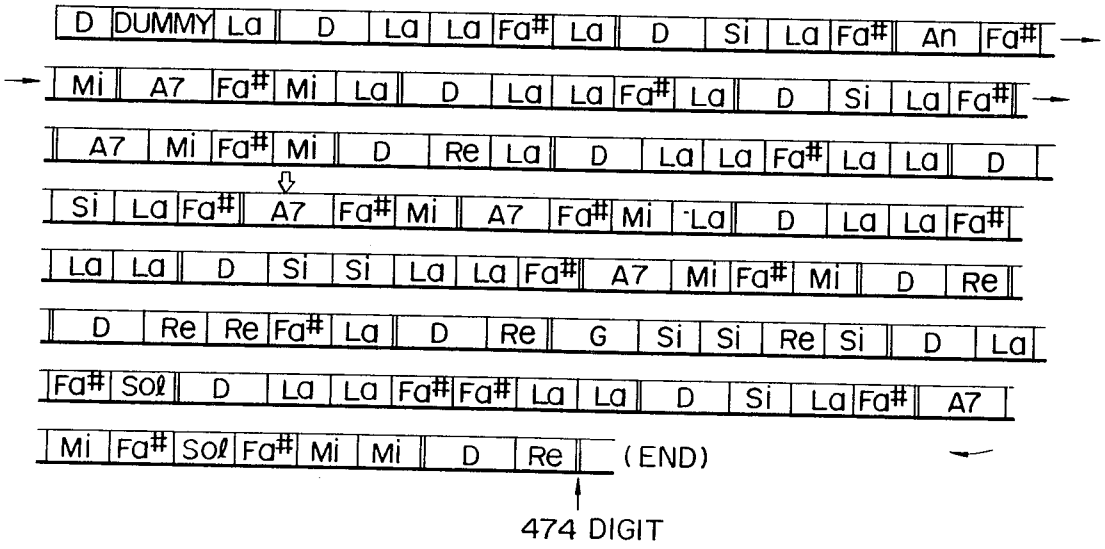
FIG. 30 is a view showing data of melody and chords of a number stored in the memory.
Figure 31:
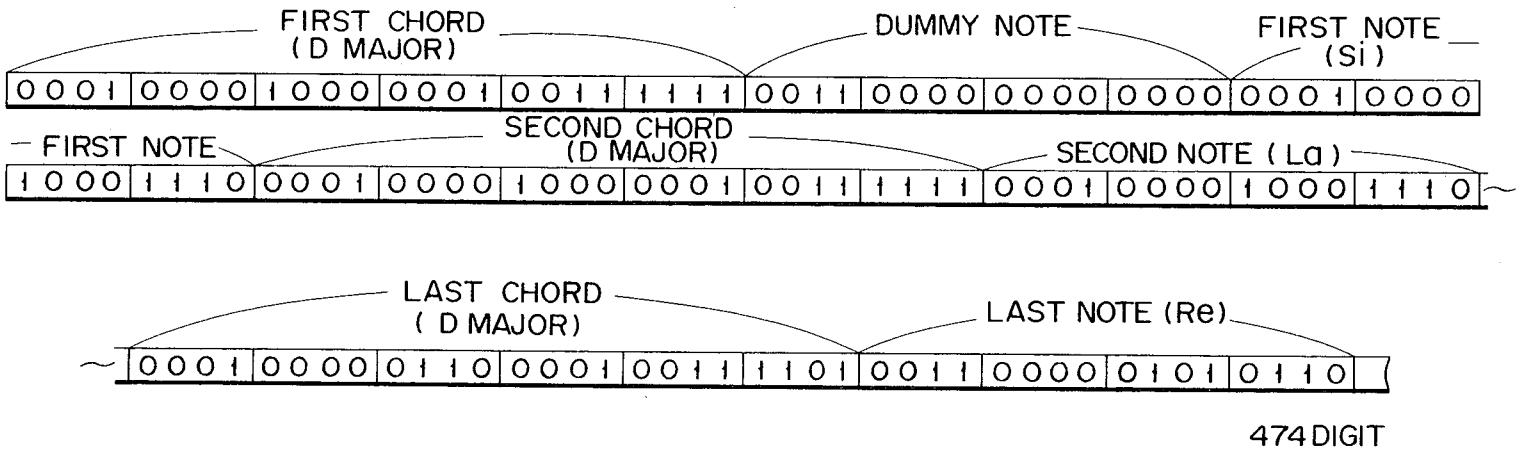
FIG. 31 is a view showing binary code record format for a first portion and a last portion of a number.

FIG. 29 shows the result of chord insertion done for the whole number "Camptown Races" in C major using the tables in the chord selection table 43. In the Figure, mark "—" denotes a portion, into which the previous note extends. It will be seen that the accompaniment chords obtained in the above way are very satisfactorily matched to the number. The selected accompaniment chords are successively converted to those in the original key (i.e., D major) in the second conversion section. The result data from the second conversion section is transferred through the data selector 30 to the CPU 13 to be written in the leading area of each block in the performance memory 18. FIG. 30 shows the arrangement of the recorded data. It is to be noted that the data content is extended for the chord record area for 25 bars (i.e., 150 digits) due to the insertion of the accompaniment chords. The last portion of the last note is then recorded in the 474th digit. FIG. 31 shows a binary code expression of first and last parts of the number data provided with the accompaniment chords.

To cause automatic performance of the number thus recorded, the mode selection switch 8 is set to the play mode position (PLAY), and after indenting the number by operating the reset key 4*l* the auto-play key 4*i* is operated. As a result, the music data in the performance memory 18 is progressively read out, and the chord progress is displayed in the display section 7 while the tones generated from the tone generating circuit 15 are coupled through the amplifier 16 to the sounding section 10 to be sounded from the loudspeaker 17.

While the operation of the above embodiment was described in connection with Foster's number "Camptown Races", according to the invention accompaniment chords can be provided for any number composed in any scale such as those which are popular in the worked or those which are familiar to the performer.

Further, while in the above embodiment various key input means were used as means for writing music data in the memory, it is of course possible to use various other writing means as well, e.g., bar code readers, magnetic readers, optical readers which can directly read a score and voice recording means.

Also, while in the above embodiment the accompaniment chord data for the number stored in the memory were inserted between the note data in predetermined blocks, this is by no means limitative, and it is possible to use a plurality of memories for separately recording the melody and chord data and reading these data synchronously.

Further, the automatic accompaniment generating apparatus can be made operative in accordance with any other suitable flow chart as well. Also, the circuit construction can be suitably changed and modified.

Moreover, while the above embodiment concerned with the case where the automatic chord inserting apparatus is provided in a portable miniaturized electronic musical instrument, it is possible to incorporate the apparatus according to the invention into large-scale console type electronic keyboard musical instruments or other music synthesizers, or it can be used as part of programmable miniaturized electronic calculators or other small size apparatus such as personal computers. Further, it can be provided as such.

The display section of the above embodiment for displaying the chord progress and chords in an automatic performance as output means for outputting the automatically generated accompaniment chords, may be modified or replaced in various ways. For example, a CRT may be provided in the apparatus for displaying the whole number together with the score thereof. As further alternatives, it is possible to produce a print output from a printer, produce an output fixed on ordinary copying sheets, to produce an output to be recorded on a magnetic tape, and to produce a punched tape output or to produce voice output.

Though chord sounds are taken as examples of accompaniment sounds being generated in the described embodiment, different sounds such as bass, arpeggio and the like may also be used as accompaniment sounds.

With the automatic accompaniment generating apparatus according to the invention, as has been shown above, accompaniment sounds can be automatically provided to the melody of a number stored in the memory through logic circuit means. Thus, beginners or those who have no knowledge of chords or who cannot hear chords can readily produce accompaniment chords by merely inputting melody.

Figure 32:
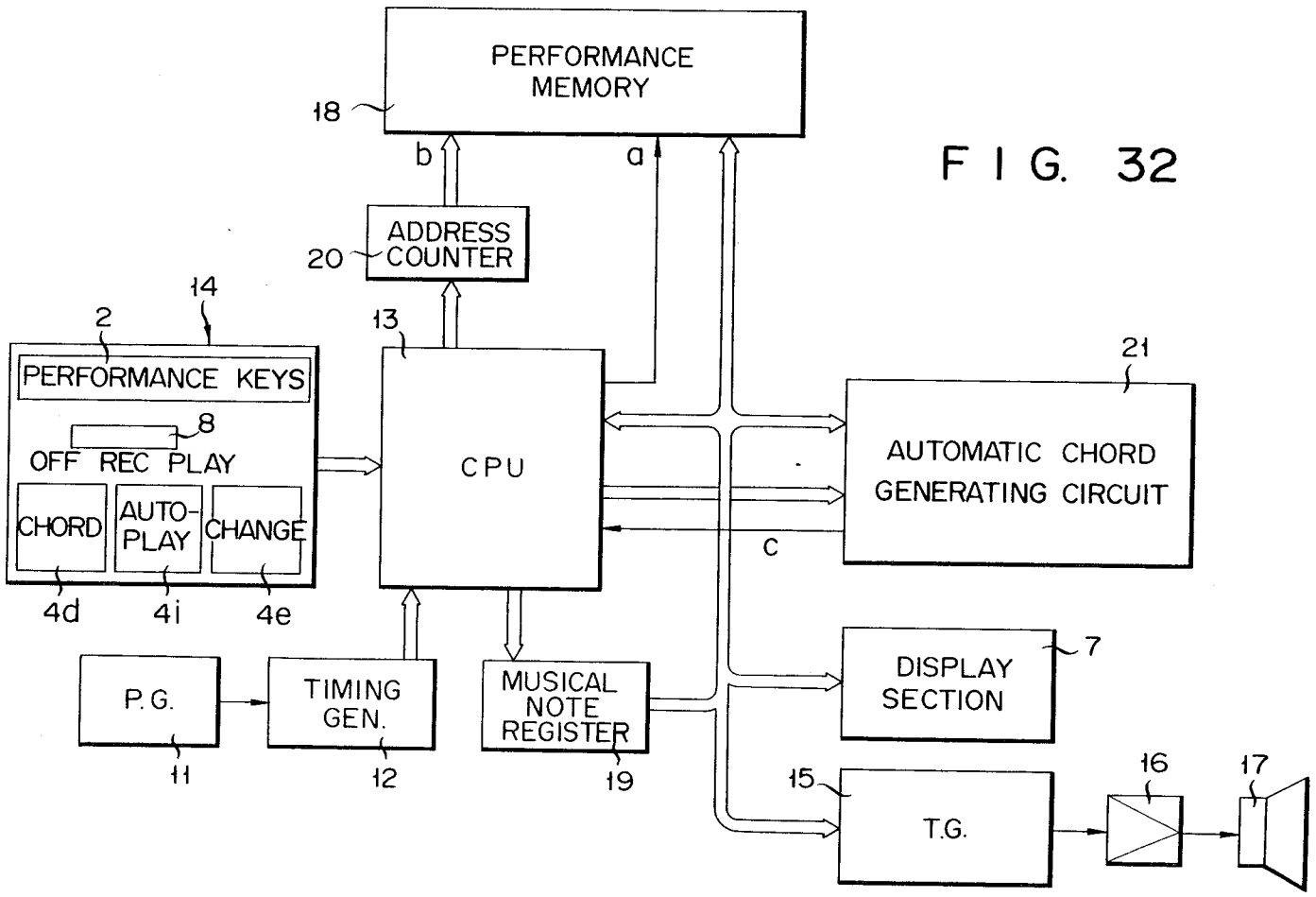
FIG. 32 is a block diagram showing the circuit construction of a different embodiment of the automatic accompaniment generating apparatus according to the invention.

During automatic performance of a number for which automatic chords have been inserted in the manner as described above, it sometimes becomes necessary to effect a chord change for a certain block. An embodiment, which permits such a chord change, will now be described. For a chord change, the change key 4*e* shown in FIG. 1 is operated. FIG. 32 shows the circuit system of this embodiment. The change key 4*e* is provided together with the chord key 4*d*, auto-play key 4*i*, etc. in key input section 14. In this embodiment, chord selection table 43 as shown in FIG. 4 includes, in addition to the tables for the cases where there is only one note, where there are two notes and where there are three or more notes in a block, a chord change table which is referred to when changing a recorded accompaniment chord to a different chord when the change key 4*e* is operated.

Figure 33:
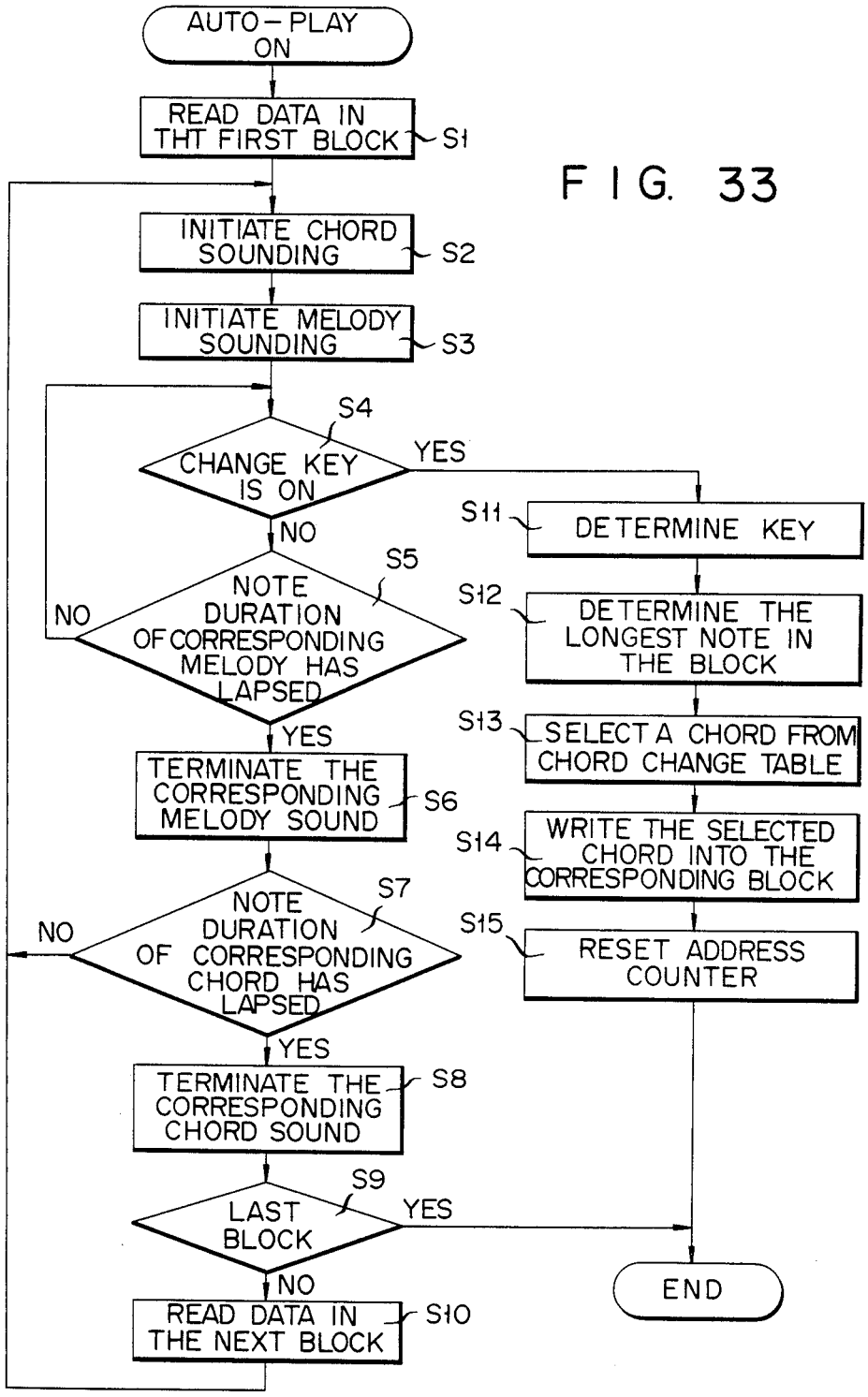
FIG. 33 is a flow chart for explaining an accompaniment chord changing operation.

The operation when effecting a chord change will be described with reference to the flow chart of FIG. 33. Since the substantial part of this embodiment is the same as the preceding embodiment shown in FIGS. 1 and 2, reference is also made to FIGS. 1 and 2 as well as FIG. 32.

It is assumed that the CPU 13, shown in FIG. 32, is providing a read/write signal a as read command to the terminal R/W of the performance memory 18. At this time, address counter 20 is supplying address data b to the memory 18. Thus, the data for the first block of the recorded number is read out; for instance, in case of the number shown in FIG. 30, D, dummy and "la" is read out as data. The data thus read out is fed to display section 7 and also to tone generator 15. The data "dummy" represents the beginning of a number. The name of chord and chord position are displayed on the display section 7. Meanwhile, the tone generator 15 produces tone signals, which are coupled through amplifier 16 to sounding section 10, whereby the melody and chord accompaniment are automatically sounded from loudspeaker 17. The operation described thus far is executed in steps S1 through S3 in the flow chart of FIG. 33.

In a subsequent step S4, a check is done as to whether the change key 4*e* is operated. If it is determined that the change key 4*e* is not operated, step S5 is executed, in which check is done as to whether the duration of the melody notes being sounded has been elapsed. The notes are sounded as the steps S4 and S5 are repeated. If it is determined that the duration has been elapsed, the sounding of the melody (i.e., notes) is stopped, and a step S7 is executed, in which a check is done as to whether the duration of the prevailing chord has been elapsed. The steps S2 through S7 are repeatedly executed to continue automatic performance of chords alone unless the duration has not been elapsed. When the duration of the chord has been elapsed, a step S8 is executed, in which the sounding of chord is stopped. In a subsequent step S9, a check is done as to whether the pertinent block is the last block. If it is not, a step S10 is executed, in which address counter 20 is incremented to read out the data of the next block from the memory 18 and sounded. If it is detected in the step S9 that the block is the last one, the automatic performance is naturally ended.

A case of changing the chord A7, as indicated by a white arrow in the fourth line in the expression of FIG. 30, to another chord while the automatic performance is done with the repeated execution of the steps S1 through S10 will now be taken. To effect the chord change during the automatic performance, the change key 4*e* is operated when the chord A7 noted above is sounded. As a result, YES yields in the step S4, and a step S11 is executed, in which the key is determined. More particularly, the CPU 13 reads out the last note "re" in the number from the memory 18 and transfers this data to the key determining section 31. The key determining section 31 shifts the note "re" toward ascending octaves by semitones up to "do", the shift here being done 10 times and being represented as D→D#→E→F→F#→G→G#→A →A#→B→C. The CPU 13 then reads out all the notes of the number from the memory 18 and transfers them to the key determining section 31. The key determining section 31 shifts the individual transferred notes 10 times and accumulates the durations of the individual notes. Here, the accumulation for "la" is done as that for "sol" and that for "fa#" is done for that for "mi". From the result of accumulation, the CPU 13 obtains C as the result key. Since this result C key is that in which the last note is "do", the result key is shifted toward descending octaves 10 times, the shift being represented as C→B→A# →A→G#→G→F#→F→E→D#→D. The result key, which is D, is set in the key register 32. Then, a step S12 is executed. In this step, all the notes in the instant block are transferred through the data selector 30 to the first converting section 33. The first converting section 33 shifts the individual notes toward ascending octaves 10 times according to the data D set in the key register 32. The resultant note data is fed to the main note determining section 40. The main note determining section 40 determines the note of the longest duration among the input notes to be the main note N1. In the instant example, "mi" among the notes "fa#" and "mi" is determined to be the main note. This note "mi" is dealt with as "re" in the main note determining section 40. This note "re" as the main note is fed to the chord selection control section 41. The chord selection control section 41 refers to the chord change table shown in FIG. 34 with respect to the input note "re" and reads out the first substitution chord G7 in the column for "re". This substitution chord G7 is fed to the second conversion section 34, in FIG. 4. This is done in a step S13. The second conversion section 34 shifts the substitution chord G7 toward descending octaves 10 times to obtain a chord A7. This chord A7 is transferred through the data selector 30 to the CPU 13. Since this chord A7 is the same as the chord A7 which is to be changed, the CPU 13 determines that the above process is ineffective and causes the chord selection control section 41 to read out a second substitution chord Dm. The second conversion section 34 shifts this substitution chord Dm toward descending octaves 10 times and transfers the result chord E7 to the CPU 13. This chord E7 is written in the place of the chord A7 in the instant block. This is done in a step S14. Then the address counter 20 is reset in a step S15. The automatic performance is stopped once, and is caused again from the beginning of the number. FIG. 35 shows the record at this time.

Figure 36:
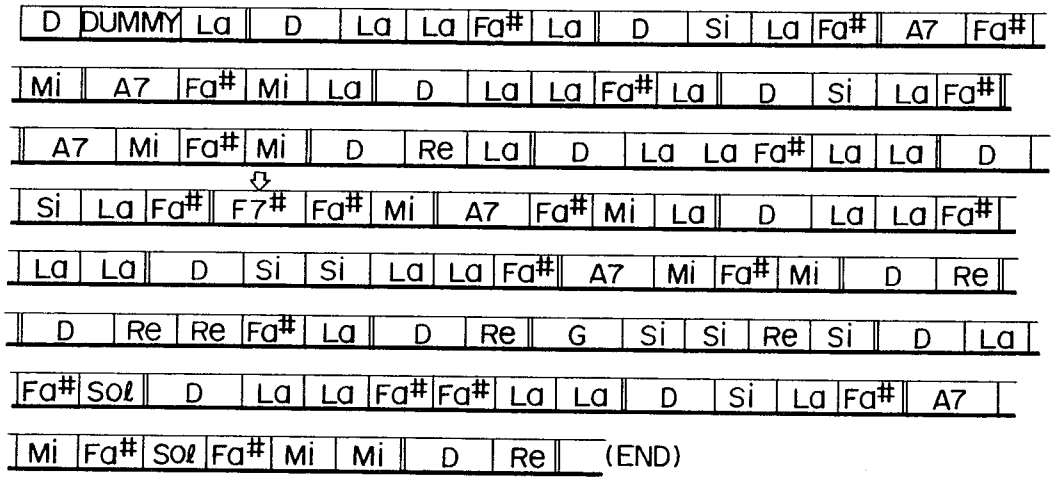

If it is desired to further change the chord E7, the change key 4*e* is operated again when the automatic performance is proceeded to the pertinent block. Then, after the step S12 is executed, the substitution chords G7 and Dm are successively read out from the chord change table to be made ineffective. The substitution chord E7 is read out. The second converting section 34 shifts this chord E7 toward descending octaves 10 times to obtain the chord F#7, which is transferred to the CPU 13. Thus, the chord E7 is changed to F#7 as shown in FIG. 36.

Figure 37:
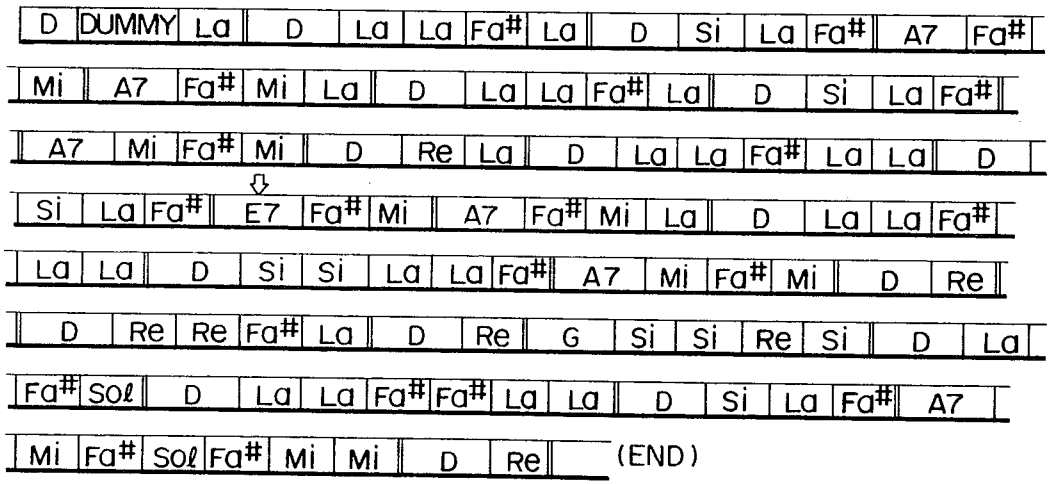

FIG. 37 shows data that results when a change of chord E#7 in the block noted above to E#7 is also done by operating the change key 4*e* a further time. In this case, the substitution chords G7, Dm and E7 are successively read out from the chord change table to be made ineffective, and then the substitution chord D7 is read out to be shifted toward descending octaves 10 times to obtain the chord E7.

FIG. 38 shows data that results when a further change of the chord D in the block denoted by a white arrow in the sixth line is done. In this case, the main note N1 is "la". The shifting of this note toward ascending octaves 10 times yields "sol". Thus, the first substitution chord G7 in the column for "sol" in the chord change table is read out and shifted toward descending octaves 10 times to obtain A7.

Figure 39A:
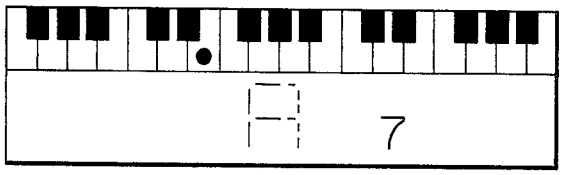
FIGS. 39A to 39D are views showing different states of a display panel in a further embodiment of the invention for explaining the changing state of the display when chord change is done by the further embodiment.
Figure 39B:
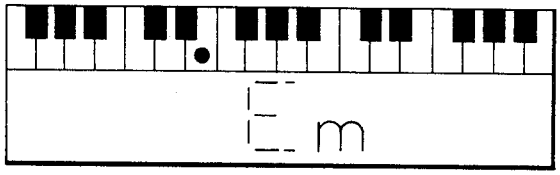
Figure 39C:
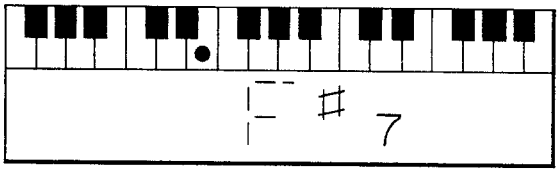
Figure 39D:
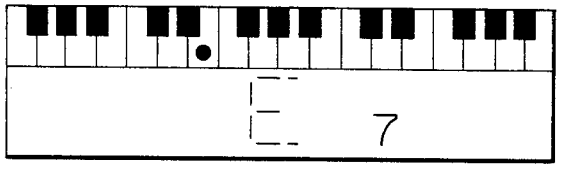

FIGS. 39A to 39D show a modification of the preceding embodiment. In this embodiment, when the change key 4*e* is operated when the block described before in connection with the preceding embodiment is reached, the display is also changed. FIG. 39A shows the display section in its state displaying the chord A7 which is to be changed as well as the position of the chord. FIG. 39B shows the state displaying the substitution chord Em and the position thereof. At this time, the address counter 20 is not reset, so that the automatic performance is held interrupted. FIGS. 39C and 39D show the states that result by operating the change key 4*e* once for changing the chord Em to F#7 and another time for changing the chord F#7 to E7.

While in the above embodiment four different substitution chords are provided for each chord to be changed, it is possible to provide any suitable number of substitution chords and also establish any suitable priority order of selection of the substitution chords.

As has been described in the foregoing, with the automatic accompaniment generating apparatus according to the invention, accompaniment can be automatically provided for the melody of a number recorded in a memory. Also, an accompaniment chord which is already determined can be automatically changed to a desired one of a plurality of substitution chords. Since the chord change thus can be readily done, it is possible to enjoy a variety of chord accompaniments.

What is claimed is:

1. An automatic accompaniment generating apparatus, comprising:

memory means for storing tone data;

input means for inputting a series of tone data including pitch code and duration code of tones forming a melody of a music number into said memory means; and logic circuit means coupled to said memory means for generating a series of accompaniment data for forming an accompaniment of the music number, wherein each of said accompaniment data is determined according to the series of tone data forming the melody stored in said memory means;

wherein the logic circuit means includes key determining means for determining a key of the music number according to the series of tone data forming the melody, and wherein said key determining means includes:

means for obtaining a shift amount according to the pitch code of the last tone of the melody stored in said memory means, means for converting each pitch code of the tone data read out from said memory means into a shifted pitch code in accordance with the shift amount obtained by said obtaining means, and for accumulating the duration code for each said shifted pitch code to obtain a total duration code for each said shifted pitch code, means for comparing predetermined ones of the total duration codes and for obtaining a shifted key of the music number which is converted by said shift amount, and means for determining the key of the music number by reversely shifting the shifted key of the music number according to a reversely shift amount which is determined by said shift amount.

2. The apparatus according to claim 1, wherein the series of tone data forming the melody is continuously stored in the memory means.

3. The apparatus according to claim 1, which further comprises control means for storing said series of data generated from the logic circuit means into said memory means.

4. The apparatus according to claim 3 which further comprises an automatic play control device for executing automatic play in accordance with the tone data forming the melody and accompaniment data forming the accompaniment stored in the memory means.

5. The apparatus according to claim 4, which further comprises means for displaying melody and accompaniment currently sounded while the automatic play control device is executing the automatic play.

6. The apparatus according to claim 1, which further comprises display means for displaying the accompaniment data generated by the logic circuit means.

7. The apparatus according to claim 1, wherein said logic circuit means includes means for separating the series of tone data forming the melody into a plurality of blocks wherein each of the plurality of blocks includes at least one tone data, and means for generating a series of accompaniment data for each of said plurality of blocks separated by said separating means.

8. The apparatus according to claim 7, wherein each of said blocks has substantially the same time length of accumulated duration code of the tone data which is included in each of the blocks.

9. The apparatus according to claim 7, wherein said logic circuit means provides an accompaniment data for each of the blocks and the apparatus further comprises first control means for storing the accompaniment data into said memory means such that the accompaniment data and the tone data are alternately arranged memory means.

10. The apparatus according to claim 9, which further comprises second control means for changing an accompaniment data stored in said memory means into a different accompaniment data and for storing the different accompaniment data into said memory means.

11. The apparatus according to claim 1, wherein the logic circuit means further comprises means for changing an accompaniment data into different accompaniment data through a predetermined operation.

12. The apparatus according to claim 11, which further comprises control means for storing said different accompaniment data obtained by said accompaniment data changing means into said memory means.

13. The apparatus according to claim 12 which further comprises automatic play control means for executing automatic play in accordance with said accompaniment data, the different accompaniment data, and the tone data stored in said memory means.

14. The apparatus according to claim 11, which further comprises means for displaying said different accompaniment data obtained by said accompaniment data changing means.

15. The apparatus according to claim 1, wherein said input means include a plurality of performance keys corresponding to notes.

16. An automatic accompaniment generating apparatus, comprising:

memory means for storing tone data;

input means for inputting a series of tone data including pitch code and duration code of tones forming a melody of a music number into said memory means; and logic circuit means coupled to said memory means for generating a series of accompaniment data for forming an accompaniment of the music number, wherein each of said accompaniment data is determined according to the series of tone data forming the melody stored in said memory means;

wherein the logic circuit means includes key determining means for determining a key of the music number according to the series of tone data forming the melody, and wherein said logic circuit means further includes separating means for separating the series of tone data forming the melody into a plurality of blocks, each block includes at least one tone data, means for generating a series of accompaniment data for each of said plurality of blocks according to the tone data included in the block and also according to the key determined by said key determining means.

17. The apparatus according to claim 16, wherein said generating means includes means for determining the tone which has longest duration code in a selected block as a main tone, and said generating means is operative to generate an accompaniment data for said selected block according to the main tone and also according to the key determined by said key determining means.

18. The apparatus according to claim 16, wherein said generating means includes accompaniment selection table means for storing a plurality of data tables, means for selecting one of the data tables stored in the accompaniment selection table means in accordance with the number of tone data included in the block, and means for supplying an accompaniment data for each block according to the selected data table and also according to the key determined by said key determining means.

19. The apparatus according to claim 16, wherein said generating means includes:

means for converting each pitch code of the tone data included in a selected block into a shifted pitch code in accordance with the key determined by said key determining means, means for obtaining a shifted accompaniment data according to the shifted pitch code in the selected block, and means for reversely shifting the shifted accompaniment data according to the key determined by said key determining means to obtain an accompaniment data for the selected block.

20. An automatic accompaniment generating apparatus, comprising:

memory means for storing tone data;

input means for inputting a plurality of tone data indicative of pitch and duration of a series of tones forming a melody of a music number into said memory means;

means for separating the series of tone data forming the melody into a plurality of blocks, each of the plurality of blocks including at least one tone data;

key determining means coupled to said memory means for determining a key of the music number according to the tone data stored in said memory means; and logic circuit means coupled to said memory means and to said key determining means for generating a series of accompaniment data forming an accompaniment of the music number according to the key determined by said key determining means and also according to the tone data stored in said memory means, each of the accompaniment data being determined for each block which is separated by said separating means, and wherein said key determining means includes;

means for obtaining a shift amount according to a pitch data of the last tone of the melody stored in said memory means, means for converting each pitch data of the tone data in said memory means into shifted pitch data in accordance with the shift amount obtained by said obtaining means, and for accumulating duration data for each of said shifted pitch data to obtain total duration data for each of said shifted pitch data, means for comparing predetermined ones of the total duration data and for obtaining a shifted key of the music number which is converted by said shift amount, and means for determining the key of the music number by reversely shifting the shifted key of the music number according to a reversely shift amount which is determined by said shift amount.

21. The apparatus according to claim 20, wherein said logic circuit means includes accompaniment selection table means for storing a plurality of data tables, means for selecting one of the data tables stored in said accompaniment selection table means in accordance with the number of tone data included in the block, and means for supplying an accompaniment data for each block according to the selected data table and also according to the key determined by said key determining means.

22. The apparatus according to claim 20, wherein said logic circuit means includes;

means for converting each pitch data of the tone data included in a selected block into a shifted pitch data in accordance with the key determined by said key determining means, means for obtaining a shifted accompaniment data according to the shifted pitch data in the selected block, and means for reversely shifting the shifted accompaniment data according to the key determined by said key determining means to obtain an accompaniment data for the selected block.

23. The apparatus according to claim 20, which further comprises an automatic play control device for executing an automatic play in accordance with tone data and accompaniment data stored in said memory means.

24. The apparatus according to claim 20, which further comprises display means for displaying the accompaniment data generated by said logic circuit means.

25. The apparatus according to claim 23, which further comprises means for displaying melody and accompaniment currently sounded while said automatic play control device is executing the automatic play.

26. The apparatus according to claim 20, wherein said logic circuit means further comprises means for changing an accompaniment data into different accompaniment data through a predetermined operation.

27. The apparatus according to claim 26, which further comprises means for displaying said different accompaniment data obtained by said accompaniment data changing means.

28. An automatic accompaniment data generating apparatus, comprising:

memory means including a plurality of memory locations;

means for inputting a series of melody tone data indicative of pitch and duration of tones forming a melody of a music number serially into the plurality of memory locations of said memory means;

means coupled to said memory means for generating a series of chord data forming an accompaniment of the music number in accordance with the series of melody tone data forming the melody in said memory means; and means coupled to said generating means for inputting the series of chord data generated from said generating means serially into the memory locations of said memory means, and wherein said generating means includes key determining means for determining a key of the music number according to pitch data or a last tone data of the melody serially stored in the memory means, and said generating means generates said series of chord data according to the key determined by said key determining means and also according to the melody tone data in said memory means.

29. The apparatus according to claim 28, wherein said generating means further includes means for determining the tone which has longest duration data among each of the memory locations as a main tone, and said generating means is operative to generate a chord data for each memory location according to the main tone and also according to the key determined by said key determining means.

30. The apparatus according to claim 28, wherein said generating means further includes chord selection table means for storing a plurality of data tables, means for selecting one of the data tables stored in the chord selection table means in accordance with the number of tone data included in each memory location, and means for supplying a chord data for each memory location according to the selected data table and also according to the key determined by said key determining means.

31. The apparatus according to claim 28, wherein said generating further includes;

means for converting each pitch data of the melody tone data included in each memory location into a shifted pitch data in accordance with the key determined by said key determining means, means for obtaining a shifted chord data according to the shifted pitch data in each memory location, and means for reversely shifting the shifted chord data according to the key determined by said key determining means to obtain a chord data for each memory location.

32. An automatic accompaniment generating apparatus, comprising:

memory means for storing tone data;

input means for inputting a plurality of tone data indicative of pitch and duration of a series of tones forming a melody of a music number into said memory means;

means for separating the series of tone data forming the melody into a plurality of blocks, each of the plurality of blocks including at least one tone data;

key determining means coupled to said memory means for determining a key of the music number according to the tone data stored in said memory means; and logic circuit means coupled to said memory means and to said key determining means for generating a series of accompaniment data forming an accompaniment of the music number according to the key determined by said key determining means and also according to the tone data stored in said memory means, each of the accompaniment data being determined for each block which is separated by said separating means, and wherein said logic circuit means includes means for determining the tone data which has longest duration data in a selected block as a main tone, and said logic circuit means is operative to generate an accomplishment data for said selected block according to the main tone and also according to the key determined by said key determining means.

33. An automatic accompaniment generating apparatus, comprising:

memory means for storing tone data;

input means for inputting a series of tone data including pitch code and duration code of tones forming a melody of a music number into said memory means; and logic circuit means coupled to said memory means for generating a series of accompaniment data for forming an accompaniment of the music number, wherein each of said accompaniment data is determined according to the series of tone data forming the melody stored in said memory means;

said logic circuit means including separating means for separating the series of tone data forming the melody into a plurality of blocks wherein each of the plurality of blocks includes at least one tone data, and each of said blocks has substantially the same time length of accumulated duration code of the tone data which is included in each of the blocks; and means for generating a series of accompaniment data for each of said plurality of blocks separated by said separating means.

* * * * *

UNITED STATES PATENT AND TRADEMARK OFFICE

CERTIFICATE OF CORRECTION

PATENT NO. : 4,539,882

DATED : September 10, 1985

INVENTOR(S) : Keiji YUZAWA

It is certified that error appears in the above-identified patent and that said Letters Patent is hereby corrected as shown below:

Column 6, line 41, after "first", the word "conversion" should be inserted;
line 57, "this" should read --the present--.

Column 7, line 32, after "shown", the words "as the last note" should be inserted.

Column 18, line 12 (claim 9), "arranged memory" should read --arranged in the memory--.

Signed and Sealed this

*Twenty-sixth* Day of *August 1986*

[SEAL]

*Attest:*

DONALD J. QUIGG

*Attesting Officer*

*Commissioner of Patents and Trademarks*